US006325523B1

(12) United States Patent
Santosuosso et al.

(10) Patent No.: US 6,325,523 B1
(45) Date of Patent: Dec. 4, 2001

(54) DISPLAY CASE WITH LENS LIGHTING SYSTEM

(75) Inventors: Joseph R. Santosuosso, Chatsworth; Bennie Reed Downing, Thousand Oaks; Fernando Calderon, Arleta; Paul Severloh, San Dimas; Raymundo Calderon, Sylmar, all of CA (US)

(73) Assignee: Anthony, Inc., San Fernando, CA (US)

( * ) Notice: Subject to any disclaimer, the term of this patent is extended or adjusted under 35 U.S.C. 154(b) by 0 days.

(21) Appl. No.: 09/417,614

(22) Filed: Oct. 13, 1999

Related U.S. Application Data

(62) Division of application No. 09/294,449, filed on Apr. 19, 1999, which is a division of application No. 08/486,523, filed on Jun. 7, 1995, now Pat. No. 5,895,111, which is a continuation-in-part of application No. 08/032,549, filed on Mar. 12, 1993, now Pat. No. 5,301,092, which is a continuation of application No. 07/865,096, filed on Apr. 8, 1992, now abandoned.

(51) Int. Cl.[7] ..... A47F 11/10

(52) U.S. Cl. ..... 362/125; 362/92; 362/290; 362/354; 62/264

(58) Field of Search ..... 362/921, 152, 362/223, 290, 354; 62/264

(56) References Cited

U.S. PATENT DOCUMENTS

| | | | | |
|---|---|---|---|---|
| 4,719,765 | * | 1/1988 | Hooper et al. | 62/264 |
| 5,450,297 | * | 9/1995 | Akashi et al. | 362/92 |
| 5,895,111 | * | 4/1999 | Santosusso et al. | 362/125 |

* cited by examiner

*Primary Examiner*—Stephen Husar
(74) *Attorney, Agent, or Firm*—Henricks, Slavin & Holmes

(57) ABSTRACT

A display case lighting system having a lens positioned inside a display came adjacent a light source inside the case for directing light across a viewing plane within the case and reducing contrasting illumination of items displayed within the viewing plane.

4 Claims, 18 Drawing Sheets

FIG. 13
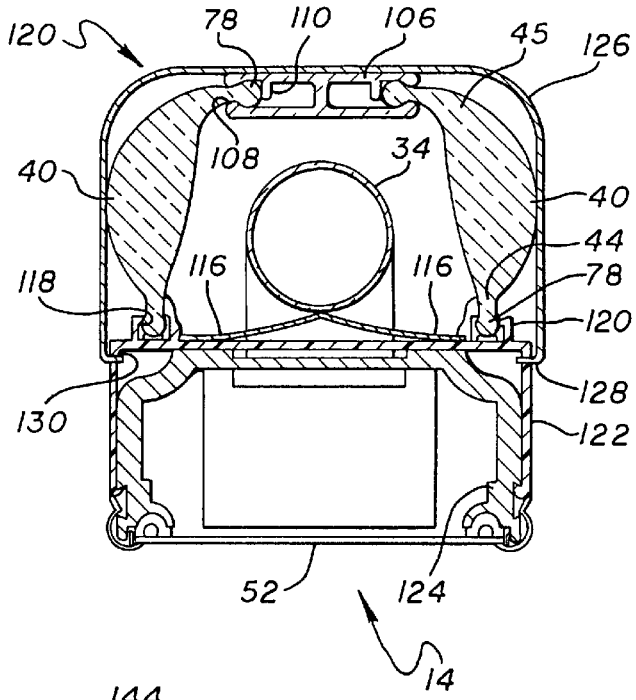
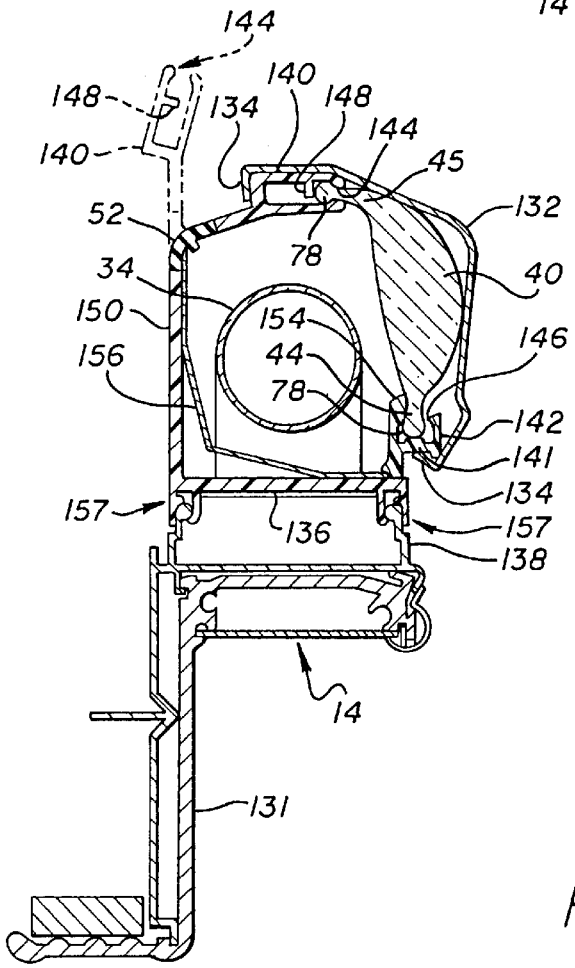
FIG. 14

FIG. 15
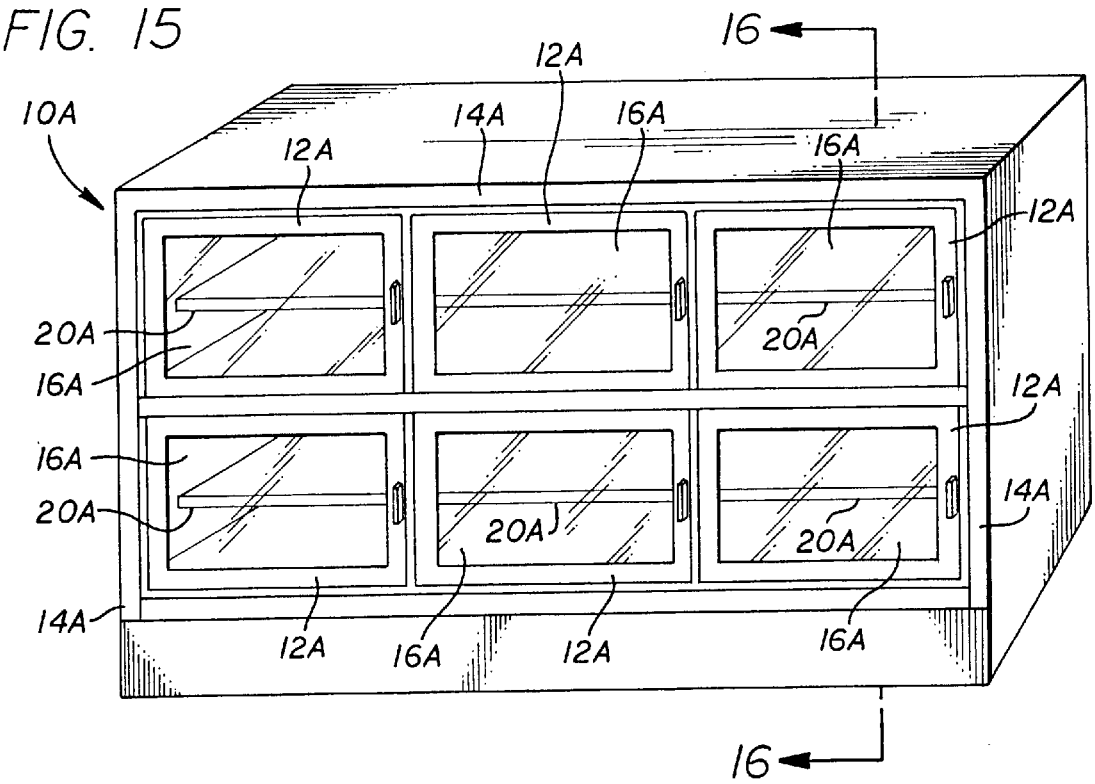
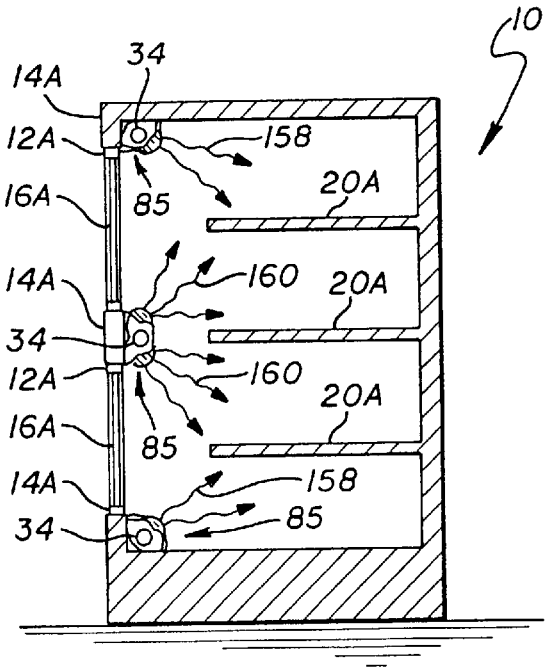
FIG. 16

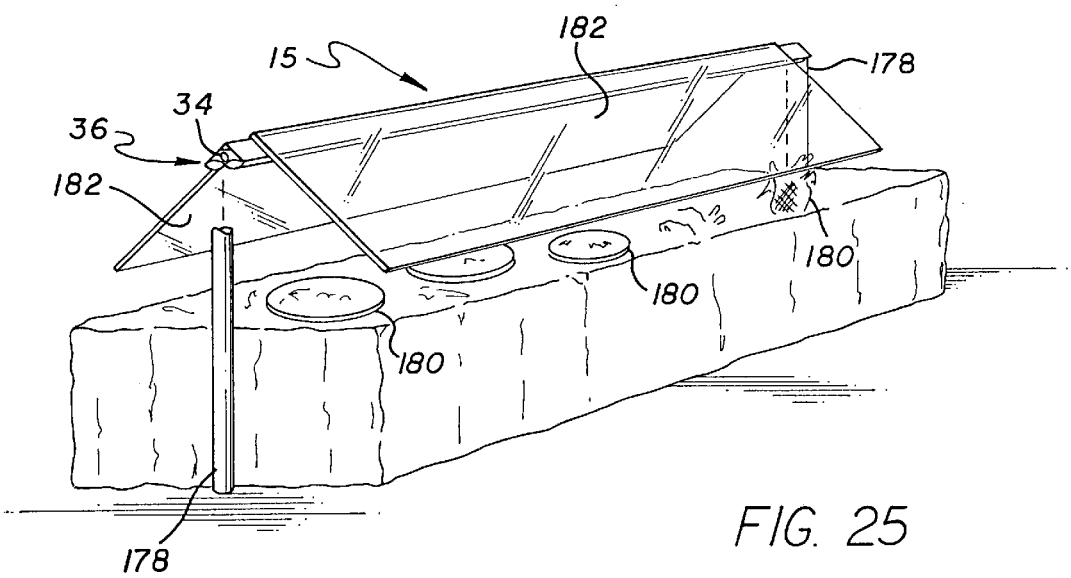
FIG. 25
FIG. 2A
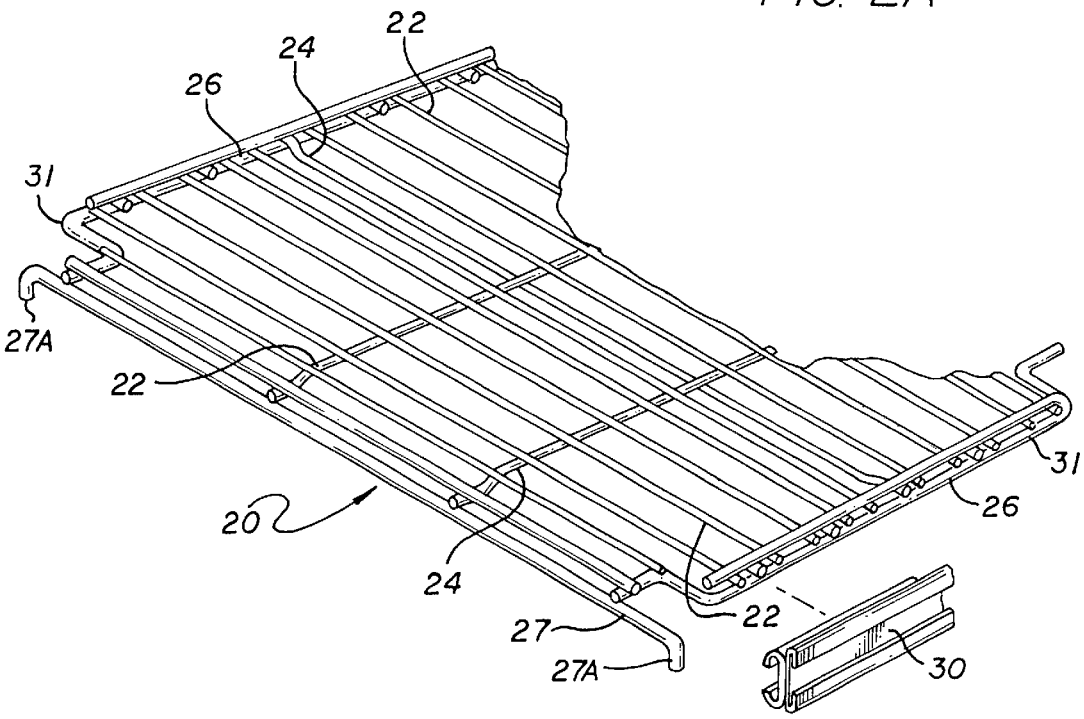

FIG. 26
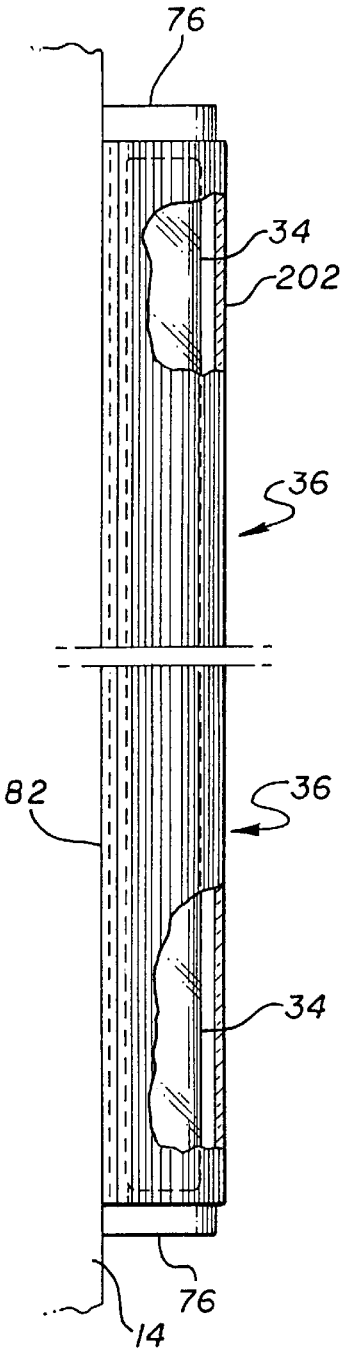
FIG. 27
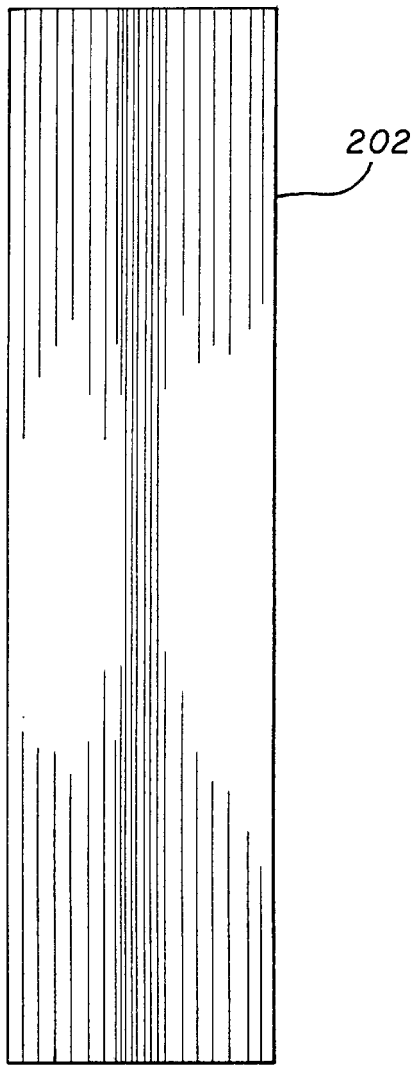
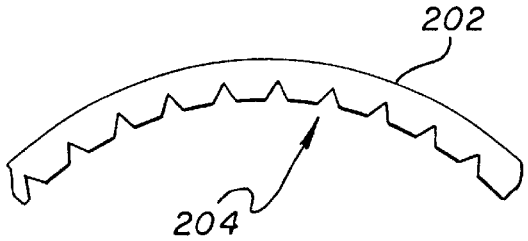
FIG. 28

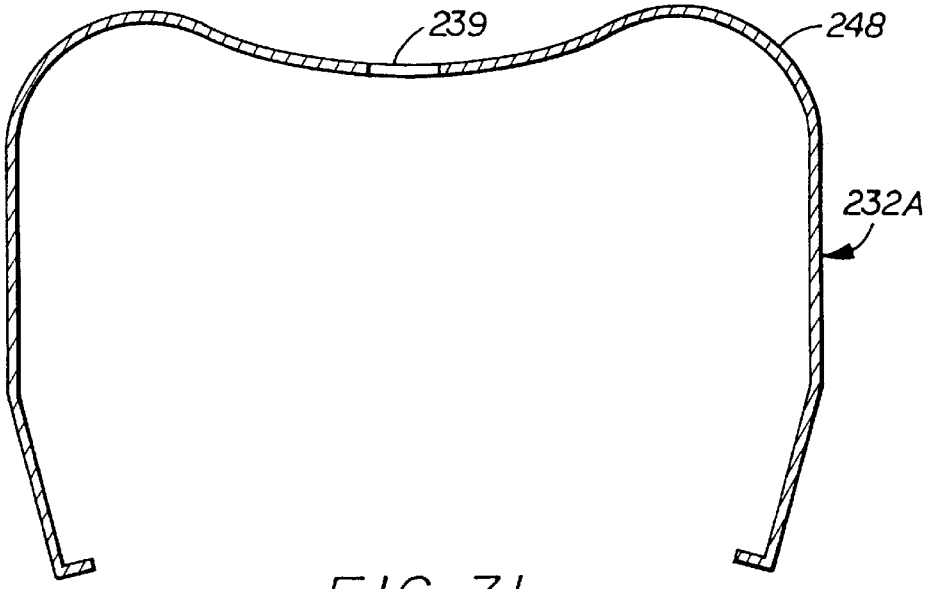
FIG. 31
FIG. 32
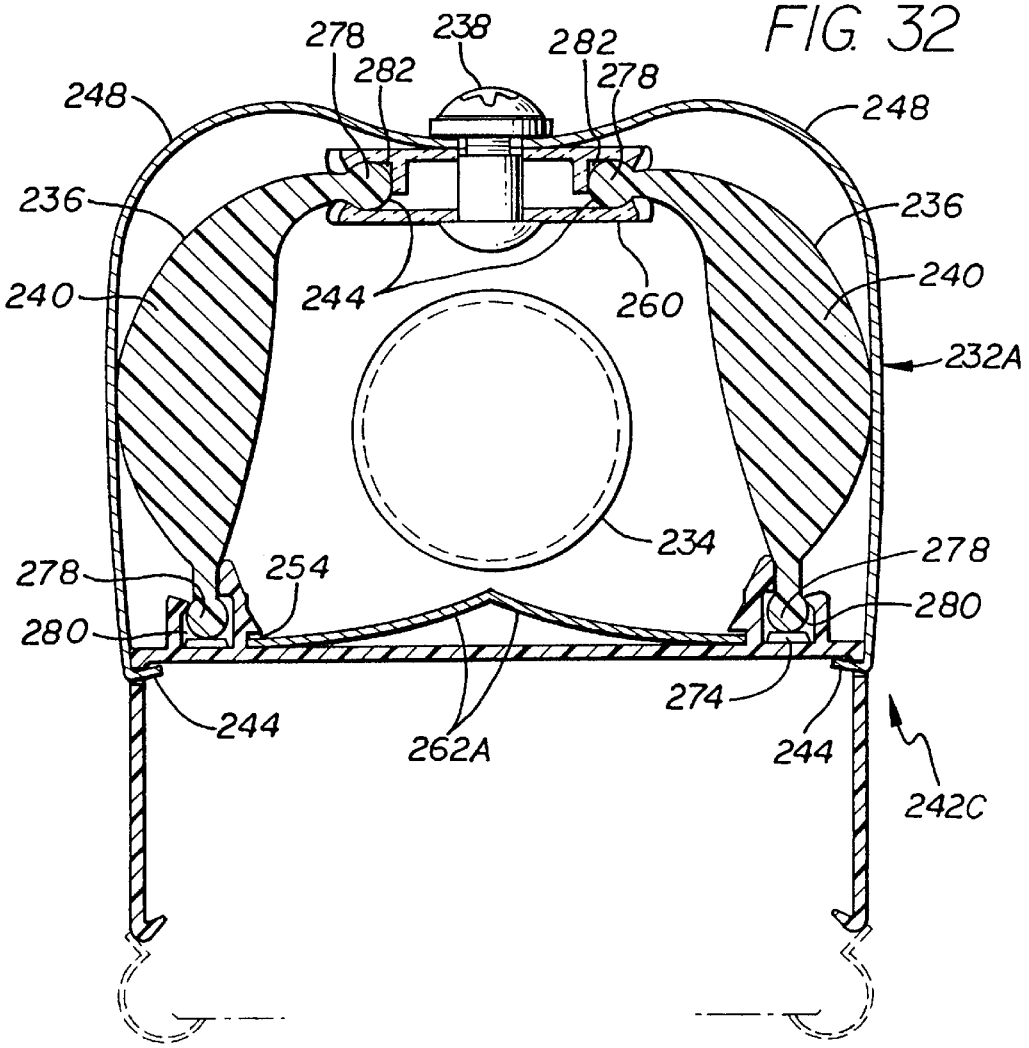

DISPLAY CASE WITH LENS LIGHTING SYSTEM

This application is a division of Ser. No. 09/294,449 filed Apr. 19, 1999, which is a division of Ser. No. 08/486,523, filed Jun. 7, 1995, now U.S. Pat. No. 5,895,111, which is a continuation-in-part of Ser. No. 08/163,276, filed Dec. 6, 1993, now U.S. Pat. No. 5,902,034 which is a continuation-in-part of Ser. No. 08/032,549, filed Mar. 12, 1993, now U.S. Pat. No. 5,301,092, which is a continuation of Ser. No. 07/865,096, filed Apr. 8, 1992, abandoned. This application is also related to Ser. No. 09/264,428, filed Mar. 3, 1999, which is a division of Ser. No. 08/541,250 filed Oct. 12, 1995, now U.S. Pat. No. 5,879,070, which is a continuation-in-part of Ser. No. 08/486,523, filed Jun. 6, 1995, now U.S. Pat. No. 5,895,111, referenced above.

BACKGROUND OF THE INVENTION

1. Field of the Invention

The present invention relates generally to lighted display cases, and more particularly to display cases having light sources that direct light inside the cases and toward the display case shelves.

2. Related Art

In the past, a variety of shelves have been used inside display cases for the purpose of displaying different items in supermarkets, or other retail establishments items for sale are typically placed on the shelves in rows or columns. For example, dairy products in a supermarket may be placed on shelves inside a refrigerated display case with the older dairy products, which need to be sold first, located near the front and middle of the shelves where the products may be easily picked up by customers. However, problems are encountered in illuminating such products.

Products located near the middle of display shelves are difficult to illuminate when vertical fluorescent tubes or other lights located near the ends of the shelves are used to light or illuminate the interior of a display case. In such a case, the products located near the lights receive more light or illumination than products located near the front and middle of the shelves. As a result, products near the middle of the shelves are insufficiently illuminated.

When products are positioned on shelving near the light sources in a display case, undesirable glare or excessively bright regions are formed about the products. This localized area of illumination adversely affects the ability to more uniformly illuminate all products at the front of the shelf. Moreover, glare is a source of distraction that diverts the attention of a viewer or consumer away from a displayed product. Any attempts to reduce the glare by decreasing the illumination results in even less lighting for the products located near the middle of the shelves.

Another common distraction to a consumer or viewer is the heightened contrast created by the uneven amount of illumination across a display case shelf when lighting is located near the ends of the shelves. When viewing a series of adjacent display cases, the alternating high and low intensity lighting across the display case shelving is both distracting and projects an image of non-uniformity. This uneven effect is particularly undesirable when displaying stock of the same product or item.

Undesirable glare about the products near the lights may be eliminated by moving or positioning the product or items further towards the rear of the case away from the immediate area of the light. However, valuable forward display and shelf space is wasted by Roving products away from the lights. By shifting product in this way, the displaced items would also be located further away from a viewer and appear distant rather than on the shelving up close near the front portion of the display case.

Problems are also encountered when horizontal fluorescent tubes are mounted inside a display case, and used to light the interior of the case. Some products located inside the case may not be sufficiently illuminated, because these products are located too far away from the light source.

SUMMARY OF THE INVENTION

It is an object of this invention to provide a display case having light sources and lenses mounted in the case that alter light distribution along the display case shelves to produce a more uniform light distribution.

It is another object of this invention to provide a display case having a lens lighting system that reduces distracting glare from the light sources, the displayed items, and display case hardware within the case.

It is still another object of this invention to provide a display case having a lens that reduces contrast or differences in illumination between products located near the front ends of the shelves by the display case lighting, and the less illuminated products located near the front middle of the shelves.

It is a further object of this invention to provide a display case having light sources and lenses mounted in the case that permits increased shelving space while still supplying sufficient light to product.

Another object of this invention is to provide a display case having light sources and lenses mounted in the case that direct light toward the shelves in order to more uniformly distribute light.

It is still another object of this invention to provide a display case having some display shelves illuminated through lenses in the case, allowing certain items on certain shelves to be illuminated better than other items on other shelves.

It is a further object of this invention to provide a display case having lenses that are used to direct light toward the interior of the case.

It is another object of this invention to provide a display case having a lens lighting system used to direct light inside the case, and which may be mounted at different locations in the case.

It is still another object of this invention to provide a display case having a lens mounting system for distributing light that is economical to manufacture.

These and other objects and advantages are obtained by a display case having lenses that distribute or direct light from lamps located on or near the display shelves toward the shelves in order to provide a more desirable (e. g., uniform) light distribution to the shelves. The lenses facilitate the illumination of items placed on the shelves near the front and middle of the shelves. Light-directing portions of the lenses evenly distribute or direct light emitted from the lamps, such as fluorescent tubes located behind the lenses, toward the display case shelves.

In one embodiment of the lenses, multiple light-directing portions located on different opposite sides of a fluorescent tube are used to direct light toward shelves located on opposite respective sides of the tube. Such an embodiment may be used near the end of two adjacent shelves within a display case. Another embodiment of the lenses uses only one light-directing portion. Such an embodiment may be used at the end of a shelf located near the side of a display case.

In another embodiment of the display case, the lenses are mounted horizontally inside the case, and used to direct light toward the interior of the case and toward the shelves inside the case.

In still another embodiment of the display case, the lenses are mounted vertically inside the case at the corners of the case. The lenses direct light toward the interior of the case and toward shelves inside the case.

It will be appreciated through application of the concepts for the present invention that vertical lighting in conjunction with illumination with objects displayed horizontally on horizontal shelves enhances the illumination of such objects that is otherwise more difficult to achieve with vertical lighting systems. The lens systems enhance the ability to provide a good illumination with a short throw across a relatively longer shelf front. Such ability to improve the apparent illumination characteristics by vertical lighting of horizontally displayed products provides more flexibility and improved product presentation for a given case. This capability also permits more flexibility in combining vertical lighting systems and horizontal lighting systems where the horizontal lighting systems can be placed at the top, bottom, or intermediate levels of a display case. For example, improved product appearance by the vertical lens lighting system may permit shorter vertical lens lighting systems and the concurrent use of horizontal lighting systems as shown in the drawings herein.

The various features of the present invention will be best understood together with further objects and advantages by reference to the following description of the preferred embodiments taken in conjunction with the accompanying drawings.

BRIEF DESCRIPTION OF THE DRAWINGS

FIG. 13 is an enlarged cross-sectional view of another embodiment of the lens taken like FIG. 8 having a metal band ed to hold the lens to a mullion cover;

FIG. 14 is an enlarged cross-sectional view of another embodiment of the lens taken like FIG. 8 having only one light-directing portion, a flexible portion in the mullion cover which facilitates mounting the lens to the cover, and a metal band used to hold the lens to the cover;

FIG. 15 is a perspective view of another display case with the present invention having doors mounted thereon and shelves mounted inside the case;

FIG. 16 is a partial cross-sectional view taken in the direction of arrows 16—16 of FIG. 15, showing horizontally-mounted lenses inside the display case directing light toward the shelves in the case;

FIG. 25 is a perspective view of another embodiment of a display case made according to another aspect of the present invention, which is a salad bar-type display case having a horizontally-mounted lens used to direct light toward food items in the case;

FIG. 26 is a further embodiment of a lens for use in the display cases in accordance with the present inventions showing a lighting arrangement using a lens formed from a grating or similar structure formed in a film or a like material;

FIG. 27 is a front elevation view of a lens material formed through a grating incorporated in the material to direct light as desired; and FIG. 28 is a partial transverse section of the lens material of FIGS. 26 and 27 showing one embodiment of a light distribution pattern in the material;

FIG. 31 is an enlarged cross-sectional view of another embodiment of the lens retaining element;

FIG. 32 is an enlarged cross-sectional view of another embodiment of the lens mounted adjacent a light source positioned on a mullion cover for a frame;

DESCRIPTION OF THE PREFERRED EMBODIMENTS

The following specification taken in conjunction with the drawings sets forth the preferred embodiments of the present invention in such a manner that any person skilled in the art can make and use the invention. The embodiments of the invention disclosed herein are the best modes contemplated by the inventors for carrying out their invention in a commercial environment, although it should be understood that various modifications can be accomplished within the parameters of the present invention.

Figure 1:
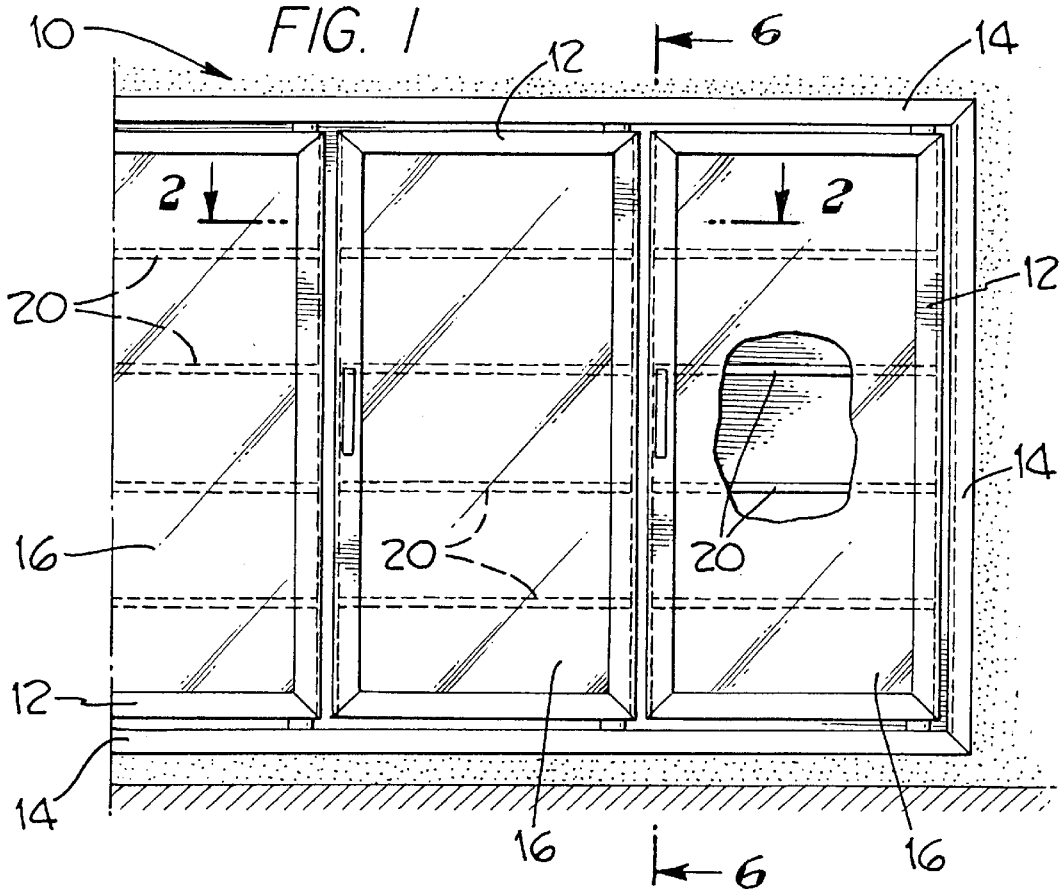
FIG. 1 is an elevational view of a display case with which the present invention may be used, having doors mounted thereon and shelves mounted inside the case.

Referring to FIG. 1, a display case 10 according to one aspect of the present invention is shown having doors 12 mounted on a surrounding frame 14. The doors 12 have glass panels 16, which allow someone, such as a customer in a supermarket, to look through the panels 16 at items 18 (see FIG. 2) displayed on shelves 20 inside the case 10. The items 18 inside the display case 10 may or may not be refrigerated items 18, such as frozen foods. Typical refrigeration units, for example, use shelves that are assembled in units approximately thirty inches in length, across the front of the unit.

Figures 2, 5:
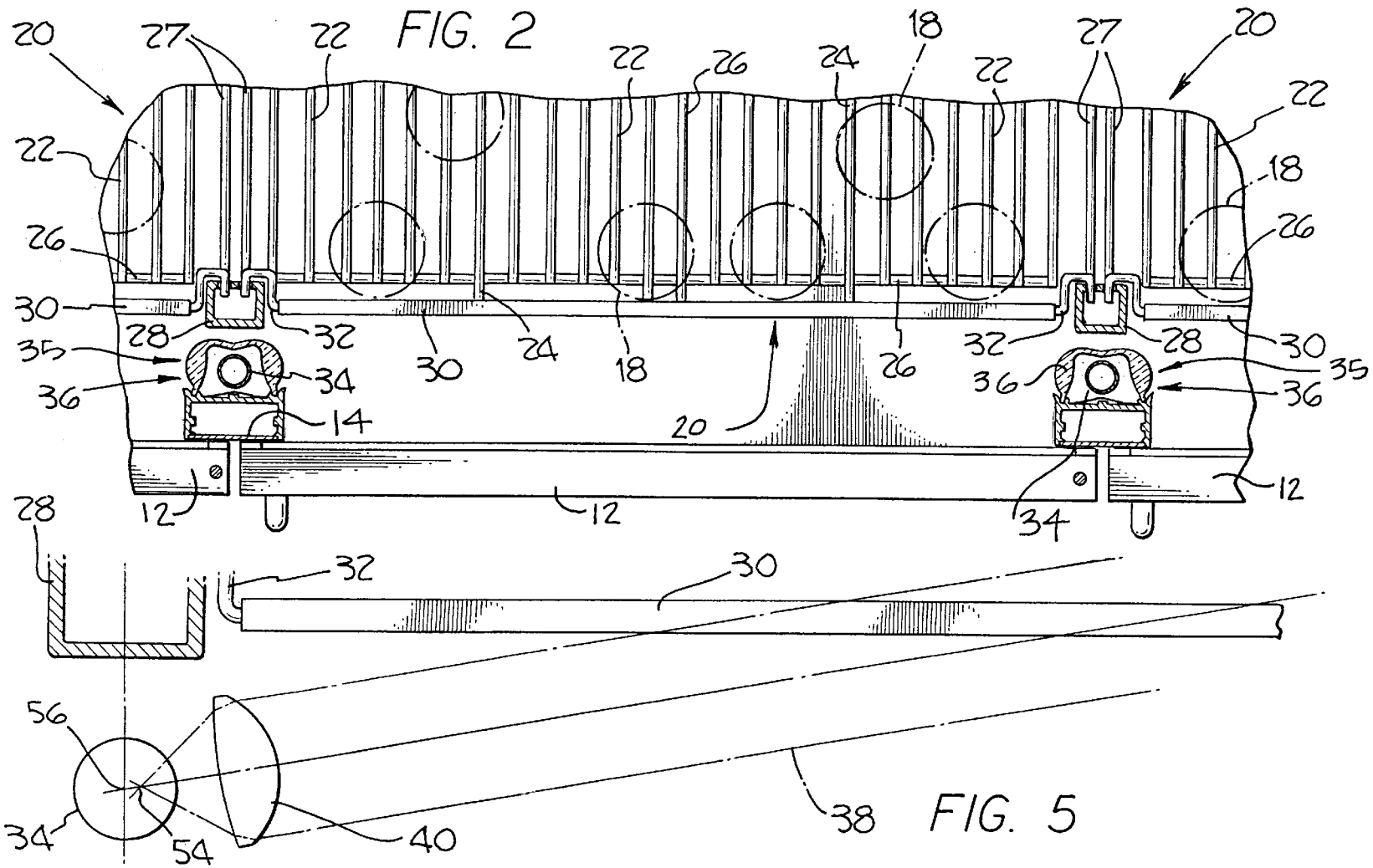
FIG. 2 is a partial cross-sectional view taken in the direction of arrows 2—2 of FIG. 1, showing lenses for directing light wherein the lenses are mounted on a frame near ends of respective shelves.
FIG. 5 is an enlarged, partial cross-sectional view showing portions of the surrounding frame and of a shelf, and schematically how the light-directing portion of one of the lenses directs light toward the shelf in order to more uniformly distribute light along the shelf.

FIG. 2 shows adjacent shelves 20 mounted at the same height or level with respect to each other within the display case 10. Each of the shelves 20 has horizontal supporting rods 22 and 24, lateral supporting rods 26, and horizontal end rods 27. The end rods 27 are mounted in column supports 28 and the back wall (not shown) of the display case 10 or in rear shelf posts. Front plates 30 are mounted to rods 24 at the fronts of the shelves 20 and to the column supports 28 by hook members 32. However, any other type of construction may be used for the shelves 20. For example, the shelves 20 may be constructed from sheet metal, may be injection molded, or the like.

As can be seen from FIG. 2, items 18 placed near the front and middle of shelves 20 in the display case 10 are difficult to light or illuminate when unaided vertical fluorescent lights or tubes 34, used to light the case 10, are located near the ends of the shelves 20, or near the front end corners of the shelves 20, as shown in FIG. 2. In such a case, items located near the front of the shelves 20 and close to the fluorescent tubes 34 will be illuminated better than items which are placed farther away from the tubes 34 and near the front and middle of the shelves 20.

Items 18 placed near the front and middle of the shelves 20 are not adequately illuminated by the light emitted from the tubes 34 because light from light sources such as tubes 34 follows the inverse-square law. In other words, as is well known, the illuminance provided to each item 18 located along the front of one of the shelves 20 by a light source (tube 34) will be inversely proportional to the square of the distance between the item 18 on the shelf 20 and the light source. In addition, the angle of incidence at which light rays strike the items 18 will be greater for items 18 located near the tubes 34 than for items 18 located near the front and middle of the shelves 20. Therefore, more light will be reflected toward the eyes of customers from items 18 near the tubes 34, possibly producing glare or other undesirable effects. As a result, items 18 located near the fluorescent tubes 34 will be illuminated better than items 18 located near the front and middle of the shelves 20, and sometimes even too such as where glare results. The present invention provides better lighting or illumination, or a more uniform lighting distribution along the length of the shelves 20, and provides more illumination for items 18 located near the front and middle of the shelves 20 than they would otherwise receive without the lens 36 of this invention.

FIG. 2 shows lenses 36 mounted on the frame 14 of the display case 10 near the ends or front end corners of the display shelves 20. The lenses 36 are mounted about the fluorescent tubes 34 and are used to direct light beams 38 toward the shelves 20 (see FIG. 5) in order to provide better lighting or illumination for items 18 located near the front and middle of the shelves 20, and to distribute the light more uniformly along the length of the shelves 20. As can be seen in FIG. 2, the lenses extend only about the tube as such as is necessary to direct the appropriate amount of light to the items displayed. Reflective material (described below) is used around the remainder of the tube, in the preferred embodiment, to direct light as desired. The lens need not extend all the way around the tube.

Figure 3:
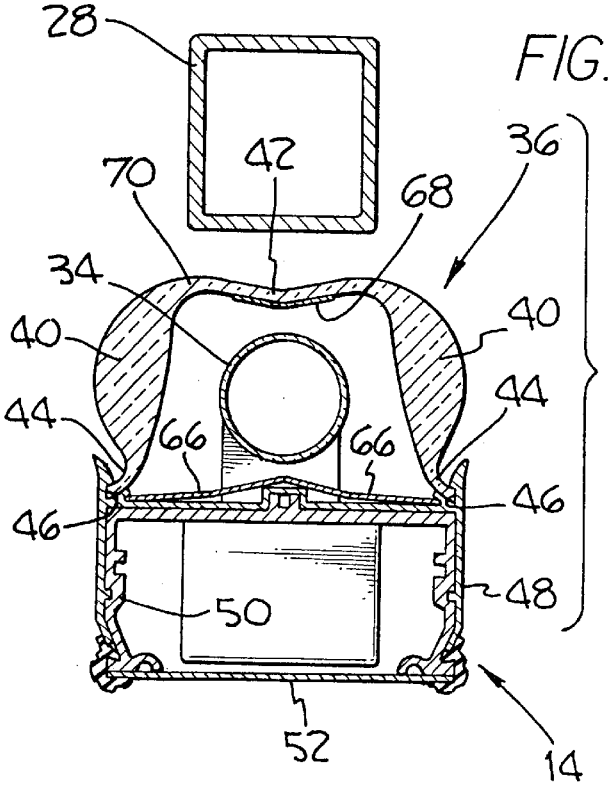
FIG. 3 is an enlarged cross-sectional view of one of the lenses mounted to a portion of the frame, adjacent a fuorescent light tube.

Referring to FIG. 3, the lens 36 has light-directing portions 40, two of which are shown in FIG. 3 connected by a top portion 42, and which are located on opposite sides of one fluorescent tube 34. The lens 36 is mounted to the frame 14 by end portions 44, which releasably engage channels 46 in a mullion cover 48 connected to a mullion 50 of the frame 14. The mullion 50 is sometimes referred to as a raceway, and provides room for wiring and the ballast 51 used for the lens lighting system of the present invention. The lens 36 is sufficiently flexible to allow end portions 44 to releasably engage channels 46. A front plate 52 is attached to the mullion 50. However, a single light-directing portion 40 may be used for the lens 36, if shelves 20 on only one side of the tube 34 are to be illuminated (see FIG. 9).

The light-directing portions 40 of the lenses 36 are designed to direct light beams 38 toward the shelves as illustrated in FIG. 5, or to alter the resulting light distribution along the length of the shelves 20 in a manner which shifts an amount of the light ordinarily directed to points nearer the light source (tubes 34) to areas located farther from the light source. Generally, the light can be directed so as to be distributed in any manner desired. Preferably, the lens 35 is designed and mounted on the frame 14 so that the focal point 54 of each of the light-directing portions 40 of the lens 36 approximately falls on, or is coaxial with, the longitudinal axis 56 of the fluorescent tube 34 surrounded by the lens 36. When so designed, light rays emitted by the tube 34 will be focused as more substantially parallel light rays, or collimated light, than without the lens directed along the length of the shelf 20 in a light beam 38 of focused light rays (see FIG. 5). As a result, the focused, substantially parallel light beam 38 will not follow the inverse-square law applicable to unaided point or line sources of light, and items 18 located near the front and middle of the shelf 20 will be adequately illuminated. The lens 36 may be designed to produce any desirable width for the beam 38.

Alternatively, lens 36 may be designed so that the focal point 54 of each portion 40 is not coaxial with axis 56 of the tube 34, but the lens 36 will still direct or distribute light along the length of the shelves 20 so that a more uniform light distribution is provided over the length of the shelves 20 than would exist without lens 36. For example, light source 34 is not, strictly speaking, a point or line source, because of the non-negligible diameter of the lamp. Therefore, lenses with focal points other than coaxial with the bulb or lamp would also be suitable for more uniformly distributing light across the front of the respective shelf. Theoretically, product on the shelves is intended to be illuminated as though by an infinite number of point sources extending across the shelf front and vertically without any glare.

Figure 4:
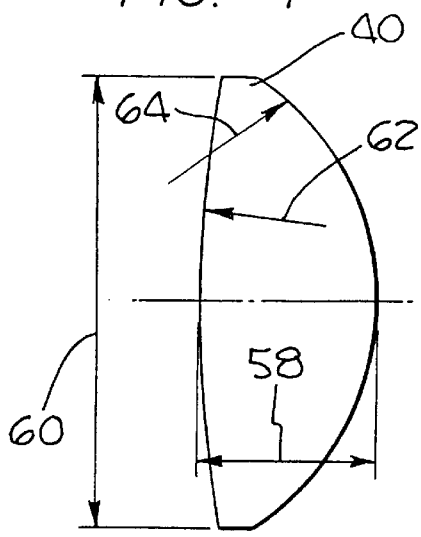
FIG. 4 is a schematic view representing a portion of one of the lenses used to direct light.

A schematic representation of one of the light-directing portions 40 is shown in FIG. 4. As illustrated, portion 40 is a convex, or positive lens. For a fluorescent tube 34 having a diameter of approximately 1.0 inch and a shelf length of approximately 3.0 feet, the light-directing portion 40 would preferably have a central thickness 58 of about 0.55 inches, an edge diameter 60 of about 1.3967 inches, an inner surface radius 62 of about 3.9646 inches, and an outer surface radius 64 of about 0.8199 inches. However, the dimensions of the light-directing portion 40 may be varied as desired to meet the lighting requirements of different size shelves 20, tubes 34, or display cases 10.

The lens 36 is preferably made out of acrylic or plastic having an index of refraction ($N_d$) of 1.4917, and an Aberration (or Abbey) No. (V) of 57.2. However, any suitable optical material may be used for the lens 36 such as glass, or the like, and appropriate modifications to the means for holding the lenses may be made, if necessary. Also, if desired, an ultraviolet (UV) light absorber may be added to the lens material. Use of a UV absorber would inhibit color fading that often occurs in products. For example, a UV absorber in the lens inhibits color fading in fresh produce, meats, clothing, package labels, and the like.

One advantage of the present invention is that the lens 36 is relatively compact, and may be easily fit between the frame 14 and columns 28. Parabolic reflectors may be used instead of lens 36 to direct parallel light rays. However, it would be difficult to fit larger size parabolic reflectors between the frame 14 and columns 28. Lens 36 as used herein is intended to include such parabolic reflectors or other reflectors.

Referring again to FIG. 3, reflectors 66 may be mounted on the mullion cover 48 under or behind the fluorescent tube 34 in order to reflect light upward or toward the light-directing portions 40. A reflector 68 may also be attached to top or front portion 42 of the lens 36 to limit the amount of light exiting through the top of the lens 36, eliminating bright or hot spots near the ends of the shelves 20. The light through the top of the lens may be eliminated entirely, if desired. The reflector 68, which may be a reflective coating or a reflecting tape, or the like, reflects light downward and toward portions 40. Alternatively, part of top portion 42 of the lens 36 may be glazed, coated, textured, or otherwise prepared to limit the amount of light escaping or exiting through the top of the lens 36, or in order to diffuse light passing through the lens 36. Preferably, intermediate top portions 70 of the lens 36, between top portion 42 and the light-directing portions 40, are not glazed or covered by reflector 68 (as shown in FIG. 3) in order to allow some light to exit the top of the lens 36 for the purpose of lighting the shelves 20 near the columns 28.

FIG. 3 shows a transverse cross-section of the lens 36. The lens 36 may have a longitudinal length approximating the longitudinal length of the tube 34 it surrounds or to which it is adjacent (see FIG. 6), or may be comprised of a number of shorter longitudinal segments or lengths preferably having a combined length equalling that of the tube 34. Also, the lights 34 may be a number of separate tubes used for each level of shelves, or other types of lights used at different heights of the display case 10. For example, a shorter version of the lens 36 may be used with a spherical-shaped bulb instead of a tube or a modified lens for a spherical source may be used.

It is intended that lens 36, as used herein, refers to any lens or reflector that directs or distributes light from a light source, such as tube 36, more uniformly over the length of a shelf. As such, lens 34 can be a positive or negative lens, a lens with prismatic or Fresnel surfaces, grooves, or a diffraction grating, a meniscus lens, a sheet of optical material wrapped or fitted around a light source having prismatic or Fresnel surfaces, grooves, or a diffraction grating in the sheet, a holographic lens or a lens formed in a film through holographic techniques, or any other type of lens used to direct or distribute light for use inside a display case or to distribute light more uniformly over the length of a shelf. The light beam directed by the lens does not have to be a focused, substantially parallel light beam like beam 38 shown in FIG. 5 but the light distribution may vary according to the square of the distance from the light source to the subject product.

The lenses 36 direct light toward the shelves 20, and more uniformly distribute light along the length of the shelves 20, or better illuminate items 18 placed toward the middle of the shelves 20. If lenses 36 are used at both ends of a shelf 20, then the corresponding light-directing portions 40 of both lenses 36 at the opposite ends of the shelf 20 will both direct light along the length of the shelf 20, combining to increase the illuminance along the shelf length and near the middle of the shelf 20. As such, the light-directing portions 40 of each lens 36 direct light toward adjacent shelves 20, or toward shelves 20 on both sides of the lens 36.

Figure 10:
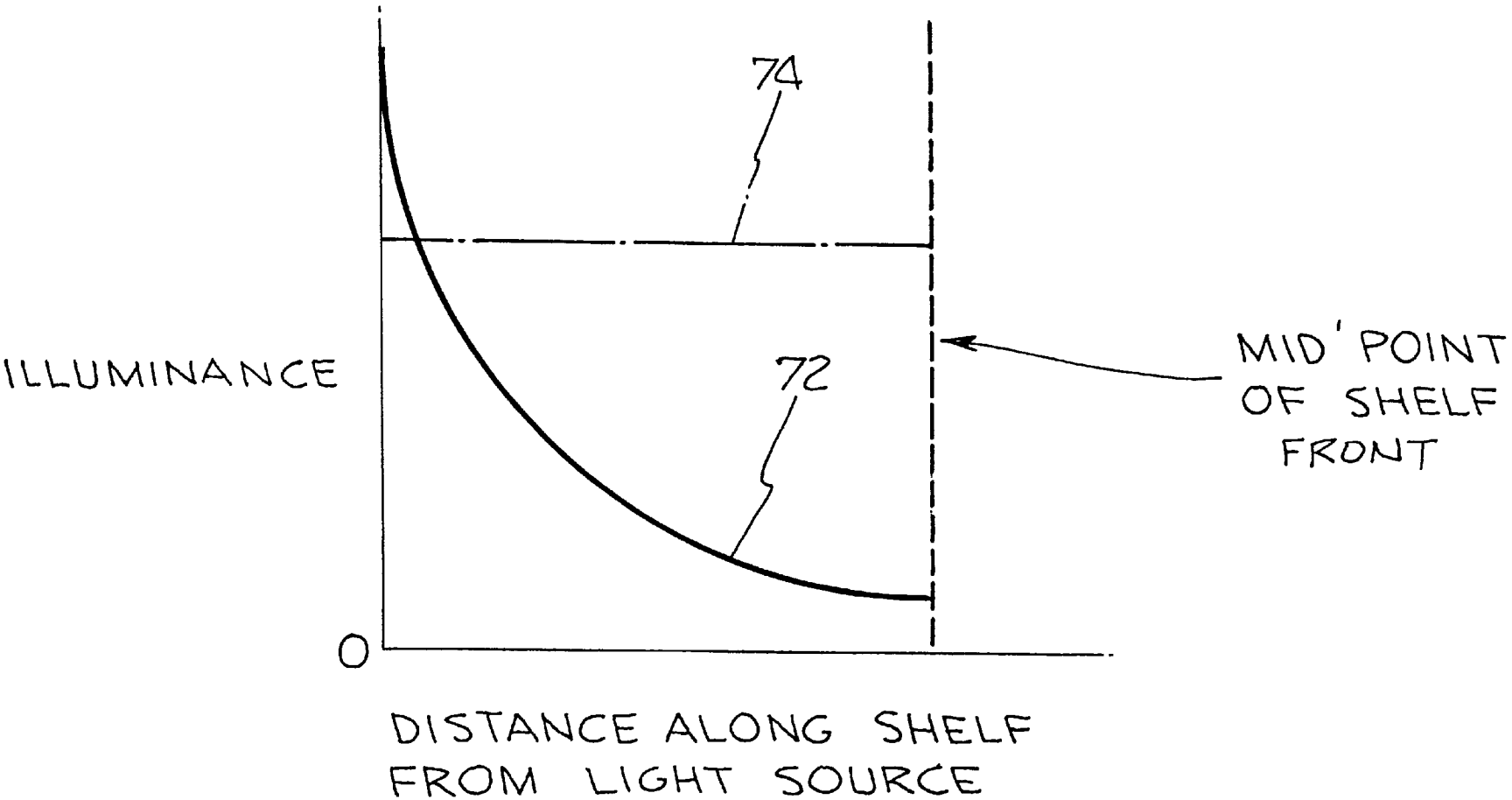
FIG. 10 is a graph schematically representing how light is distributed along the length of a shelf from a light source, such as a fluorescent light tube without the lens of this invention, located at one end of the shelf, and light ideally distributed uniformly along the length of the shelf by use of the lens of this invention.

FIG. 10 is a graph schematically representing how light is distributed along the length of the shelf 20 by one of the tubes 34 located at one end of the shelf 20 following the inverse-square law (curve 72). Curve 74 shown in FIG. 10 ideally represents a uniform light distribution for the products on the shelf 20, especially those along the shelf front, that is the optimum situation for the present invention if the physical assumptions of the point or line sources and the like are achievable.

Figure 6:
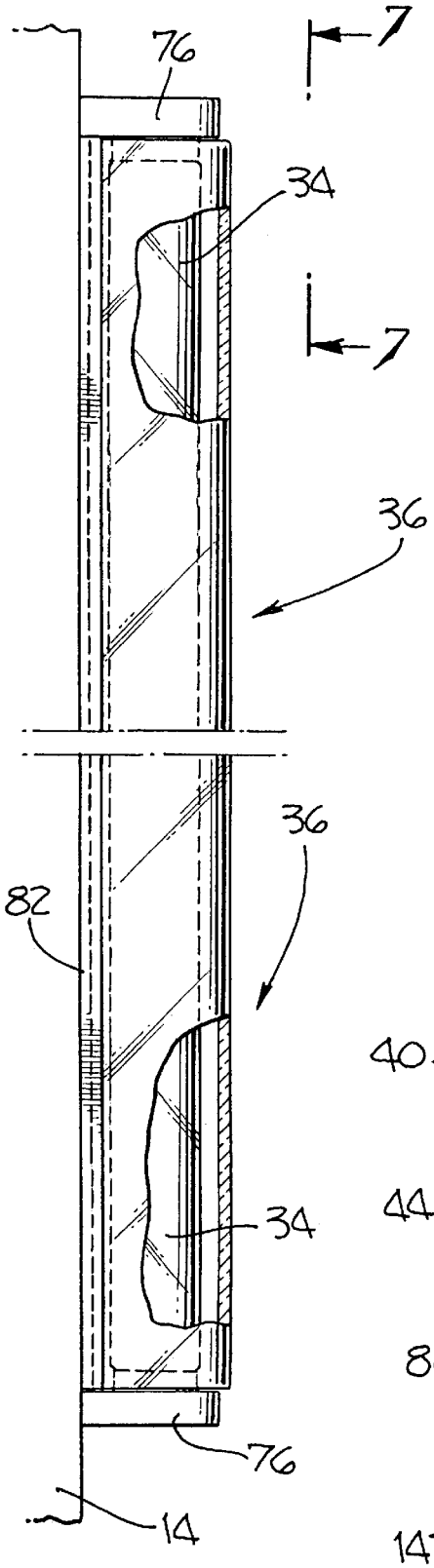
FIG. 6 is a side elevational view taken in the direction of arrows 6—6 of FIG. 1 of upper and lower portions of one of the lenses shown adjacent a vertically-oriented fluorescent tube (middle portions of the lens and tube being omitted)
Figure 7:
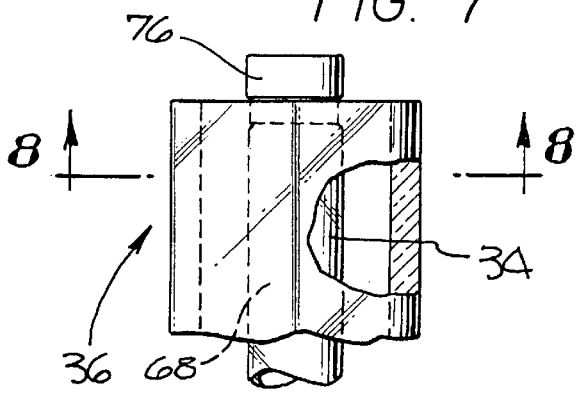
FIG. 7 is an enlarged, detailed front view of the upper end of the lens of FIG. 6.

FIGS. 6 and 7 show how the elongated lens 36 fits around the fluorescent tube 34, which is connected to sockets 76 at the ends of the tube 34. It should be noted that the phantom view of the tube 34 through the actual lens 36 would be distorted or changed by the lens so that it would not look the same with the lens as without the lens.

Figure 8:
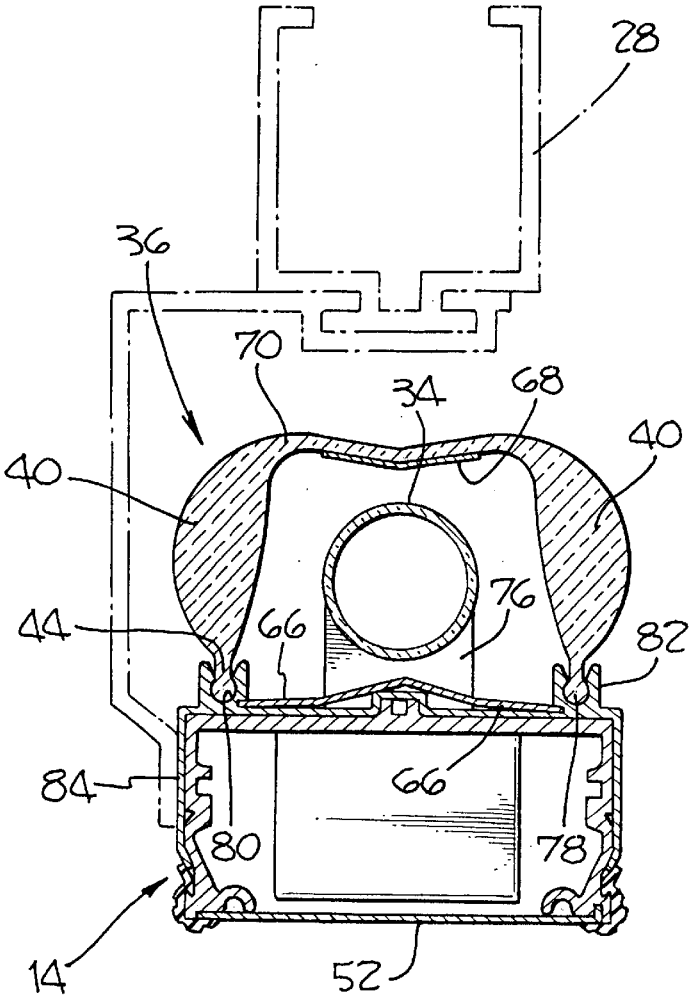
FIG. 8 is an enlarged cross-sectional view of another embodiment of the lens, taken in the direction of arrows 8—8 shown in FIG. 7.

FIG. 8 shows the preferred embodiment of the lens 36 having elongated cylindrical portions 78, attached to end portions 44, that engage preferably correspondingly elongated apertures 80 in elongated extensions 82 of mullion cover 84. The lens 36 is sufficiently flexible such as at intermediate portions 70 to allow portions 78 to engage apertures 80. As shown, reflectors 66 are mounted on the mullion cover 84.

It is important to note that any desirable means may e used to attach the end portions 44 of the lens 36 to the mullion cover 84. It is intended that the present invention not be limited by the leans used to attach the lens 36 to the mullion covers 48 and 84, or to the surrounding frame 14.

Figure 9:
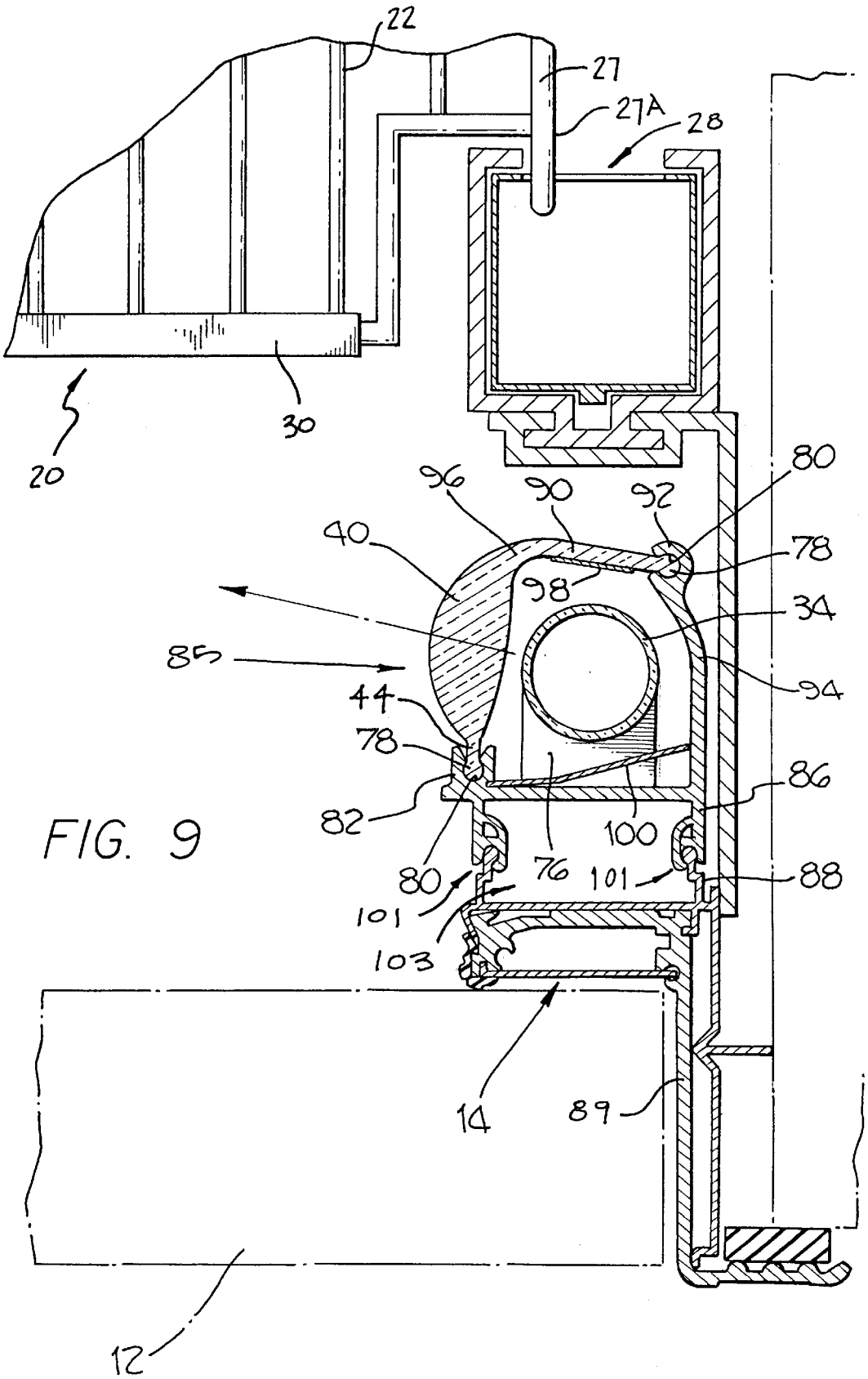
FIG. 9 is an enlarged cross-sectional view of another embodiment of the lens taken like FIG. 8 having only one light-directing portion.

FIG. 9 shows another embodiment of the lens 36 having only one light-directing portion 40. Such a lens design may be used, for example, near the end of a shelf 20 located adjacent the side of the display case 10, or if it is desirable to direct light only toward one of two adjacent shelves 20.

Light-directing portion 40 has end portion 44 with an elongated cylindrical portion 78 which engages elongated aperture 80 in elongated extension 82 of housing 86 attached to frame cover 88 of frame 89. Portion 40 also has an elongated end portion 90 with an elongated cylindrical portion 78, which engages elongated aperture 80 in elongated extension 92 of an upright portion 94 of the housing 86.

The lens 36 of FIG. 9 preferably has reflectors 98 and 100. Reflector 100 directs light toward portion 40, and reflector 98 prevents light from exiting through elongated end portion 90 of the lens 36 and causing bright spots near the end of the shelf 20. However, reflector 98 is sized so as to not cover portion 96 of the lens 36 between portions 40 and 90, allowing sufficient light to exit through portion 96 for the purpose of lighting or illuminating the adjacent end of the shelf 20. As discussed above, elongated end portion 90 may be glazed, coated, textured, or otherwise prepared to diffuse light through portion 90, if desired.

The lens design shown in FIG. 9 may be used in any combination with the lens designs shown in FIGS. 3 and 8 for displays as desired. As such, any combination of features disclosed in this application may be combined in any desirable manner. It should be noted that the housing 86 and frame cover 88 include releasable engagement means 101 for forming a reliable engagement between the two to permit easy installation and assembly of the housing 86 onto the frame cover or other part of the frame, whether it be a vertical or horizontal portion of the frame. The frame cover 88 preferably includes a longitudinally extending bead to engage a corresponding groove in each side of the housing 86, the housing and frame cover combining to form a raceway 103 for conductors and the like. The housing and the light assembly are easily slipped onto the frame cover for counting the light assembly on the frame. With this design of the releasable engagement, the same light and lens assembly can be used for any number of different frame designs. The mounting of the assembly onto the frame would simply use a frame cover formed for the particular frame design and having the longitudinally extending beads. Light sources and lens assemblies may then be interchangeable, permitting different lenses to be used with a given light source, and different light sources and their appropriate lenses to be placed in a case in any number of different configurations. For example, the light source and lens assembly can be placed on shelves, as discussed with respect to FIGS. 18 and 20 below, or on non-structural components of the case. The compatibility of the engagement means makes easy installation possible.

In the case of display cases that do not use lenses like the lens 36 of the present invention, the front portions of items positioned near the front and middle of display shelves, such as the flat front sides of box-shaped containers, will not be adequately illuminated by lights such as fluorescent tubes located at the ends of the shelves.

The display case 10 may have some shelves 20 that use lenses 36, and other shelves 20 for which lenses 36 are not used. As a result, certain items 18 on some of the shelves 20 will be lighted better than other items 18 on other shelves 20. This may be desirable, for example, if a store owner wishes to draw customers attention to some items more than others. Also, it may be desirable to provide better lighting for more popular items 18 located on waist-high shelves 20 within easy reach of customers. Less popular items 18 may be placed on the shelves that do not use lenses 36. Also, some of the adjacent shelves at the same height or level in the display case 10 (having more than one door 12) may use lenses 36, and some may not use lenses 36.

It is important to point out that the fluorescent tubes 34 and lenses 36 do not have to be located exactly at the ends of the shelves 20 of the display case 10. As such, the tubes 34 and lenses 36 may be moved closer to or farther away from the middle of the shelves 20. In addition, the fluorescent tubes 34 and lenses 36 may be mounted on any part of the display case 10.

Figure 11:
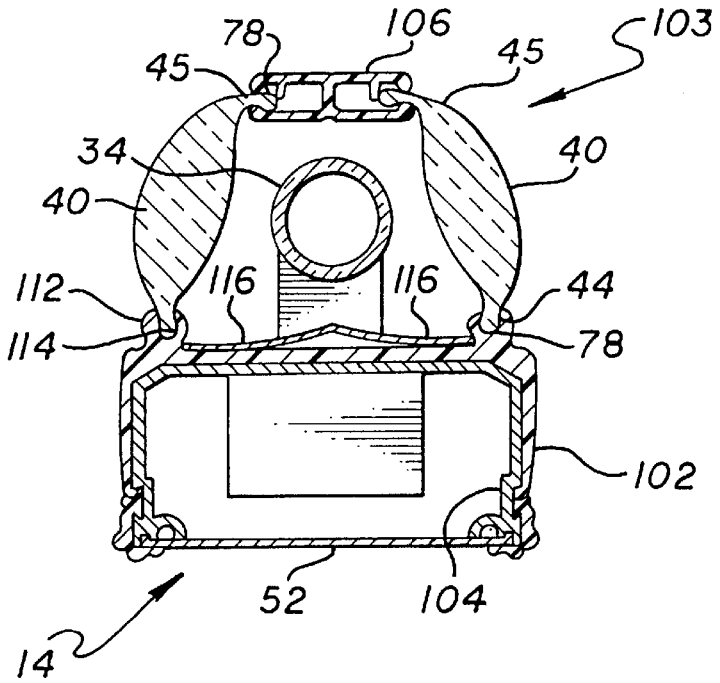
FIG. 11 is an enlarged cross-sectional view of another embodiment of the lens taken like FIG. 8.
Figure 12:
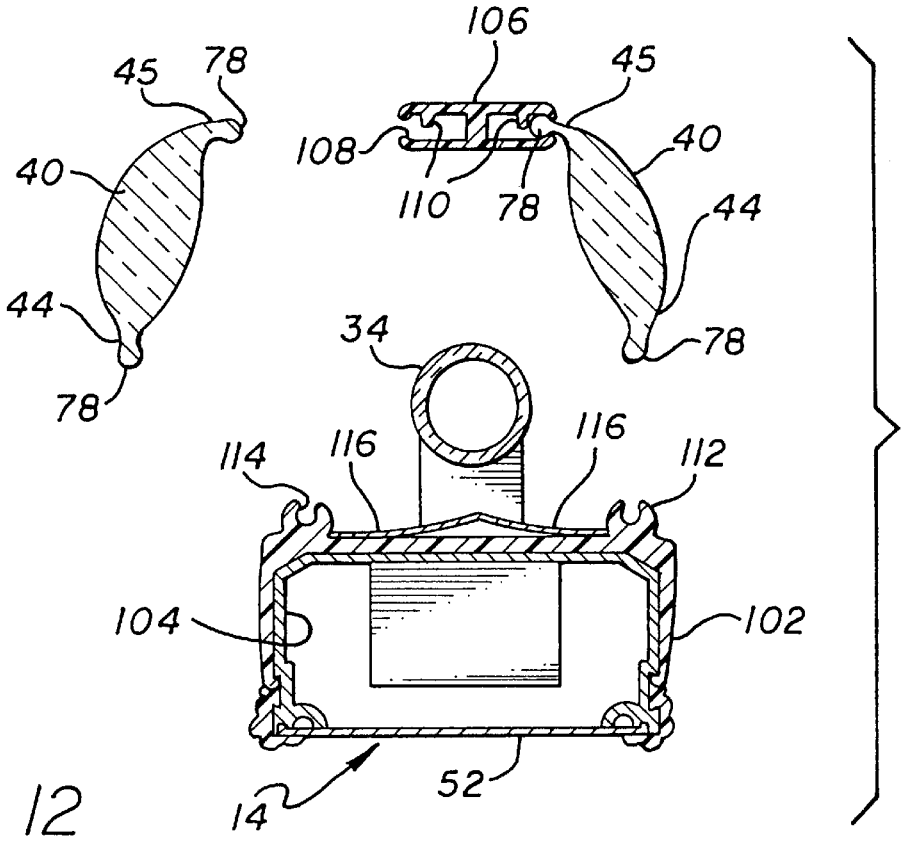
FIG. 12 is an exploded, enlarged cross-sectional view of the lens of FIG. 11.

FIGS. 11 and 12 show yet another embodiment of the lens 36 having two separate light-directing portions 40 releasably connected by an elongated web member 106. The lens 36 is mounted to the frame 14 by elongated cylindrical portions 78 of end portions 44, which releasably engage elongated apertures 114 in elongated extensions 112 of a mullion cover 102 connected to a mullion 104. Portions 40 have end portions 45 (at the other ends thereof) with elongated cylindrical portions 78, which engage elongated slots or apertures 108 in web member 106.

The light-directing portions 40 may be mounted on the frame 14 around a fluorescent tube 34 by inserting portions 78 into apertures 108 and 114 in web member 106 and extensions 112, respectively. Note that the elongated member 106 has elongated flanges or stops 110 (FIG. 12), which control how far portions 78 may be inserted into member 106. Each lens, as with the previously described lenses, is preferably designed to have a throw of fifteen inches where the light sources are placed thirty inches apart, for a standard unit shelf width or length of thirty inches, and a similar door width. For other configurations the light sources may have a different spacing. Additionally, the lenses may have a different focal length, may be closer to or farther from the light source, or the angle of the lens may be changed. Also, the lens may take other forms, such as an almost plano-convex lens as shown in FIGS. 13, 14, 18 and 20. Additionally, the lenses may be made adjustable.

Reflectors 116 are mounted on the mullion cover 102. Elongated web member 106 is preferably fabricated from clear PVC (polyvinyl chloride), styrene, any plastic, or any other suitable material. The material may also be opaque and even non-transparent, as desired, depending on the application.

Separate and discrete lens structures for a dual lens arrangement, such as is shown in FIGS. 11 and 12, are beneficial for several reasons. Separate lenses are easier to manufacture and the same lens design may be used as a dual lens construction or as a single lens. Additionally, where display cases are relatively uniform, such as for shelf size, lamp dimensions, and the like, the lens can be used in a number of arrangements without changing the lens design but by changing its mounting arrangement and orientation.

Another embodiment of the lens 36 is shown in FIG. 13. This embodiment also has two separate light-directing portions 40 releasably connected by elongated web- member 106. A mullion cover 122 is used to mount the lens 36 to a mullion 124. As shown, the elongated cylindrical portions 78 of portions 40 releasably engage elongated apertures 118 in elongated extensions 120 of the mullion cover 122. Also, elongated cylindrical portions 78 of end portions 45 engage elongated apertures 108 in web member 106.

A metal or other suitable band or clip 126 is used near preferably each end of the lens 36 for the purpose of assisting in holding the lens 36 to the mullion cover 122. End or flange portions 128 attach the bands 126 to the mullion cover 122. Portions 128 may engage apertures 130 in the mullion cover 122, or may be attached to the cover 122 using any suitable fastening means. The metal bands 126 are useful in holding the lens 36 and any other associated hardware to the mullion cover 122 during installation and transportation of the lens lighting system, and help to hold the lens 36 in place after installation thereof. The bands preferably extend longitudinally of the lens only about one half inch.

FIG. 14 shows another embodiment of the lens 36, which uses only one light-directing portion 40. This lens 36 embodiment may be used like the lens 36 of FIG. 9, as discussed above. FIG. 14 depicts a frame 131 which is a horizontal frame portion but which could also be a vertical frame portion, depending on the particular location of the frame where the section shown in FIG. 14 is taken. Horizontal lights are useful for a number of reasons, many of which relate to particular case designs, such as shelf location, other light source locations, frame construction and the sizes of other light sources. For example, standard fluorescent bulbs typically come in two-, four- and five-foot lengths. Sometimes a four and one-half foot light source would be useful because of shelf location, came height and the like. Therefore, a horizontally positioned source at the top or bottom of a standard four-foot light source provides the extra light desired to illuminate a shelf or other location. The light-directing portion 40 has end portion 44 with elongated cylindrical portion 78, which engages elongated aperture 146 in elongated member 142 of housing 136 attached to frame cover 138 for frame 131. An elongated stop 141 of member 142 is used to control how far portion 78 may be inserted into member 142. Member 142 has elongated extension 154 attached thereto. Extension 154 is used to cushion and portion 44, or to facilitate mounting of the lens 36 to the housing 136, as explained below. Preferably, extension 154 is fabricated from rubber, neoprene, or any suitable material.

The housing 136 has an upright portion 150 with an elongated member 140 at the end thereof and an elongated flexible portion 152 therein, as shown in FIG. 14. Flexible portion 152 may be fabricated from rubber, neoprene, or any suitable flexible material. The light-directing portion 40 has end portion 45 with elongated cylindrical portion 78, which engages elongated aperture 144 in member 140. Elongated stop 148 of member 140 controls how far portion 78 may be inserted into member 140. Flexible portion 152 allows upright portion 150 to be bent or moved to the right (when viewed as shown in FIG. 14), so that cylindrical portion 78 of light-directing portion 40 may be inserted into member 140. The flexible portion 152 of the elongated member 140 is preferably inherently biased to take the position shown in phantom in FIG. 14 when the lens is removed from aperture 144. When the lens is removed, the elongated member 140 will spring outward to permit access to the bulb and other portions of the mullion cover. The flexible portion 152 also provides structural integrity. The rubber or neoprene extension 154 facilitates the installation of portion 40, by cushioning end portion 44 as cylindrical portion 78 is inserted into member 140.

A metal band or other type of clip 132 near each and of the lens 36 helps to hold the lens 36 to the housing 136. The metal band 132 has elongated flanges 134 at the ends thereof, which are used to attach the band 132 to elongated members 140 and 142, as shown in FIG. 14 and to hold the band in place and therefore the lens. Reflector 156 is mounted to the housing 136.

As with the embodiment shown in FIG. 9, the embodiment of the lighting system of FIG. 14 includes an engagement assembly 157 for easily mounting the light assembly on either a vertical or horizontal portion of the frame, embodiments of several frame portions being shown herein. The engagement assembly preferably includes a longitudinally extending bead on the frame cover 138 for engaging a corresponding longitudinally extending groove in the housing 136 to define a raceway for conductors. The housing 136 and its light assembly would then form an integral unit mountable on any frame portion, vertical or horizontal, having appropriately mating beads for engaging the grooves. Therefore, the housing 136 and the light assembly may be considered a universal design for vertical and horizontal mounting on a frame portion, when the frame portion includes an appropriate sating design.

FIG. 15 shows another display case 10 of the present invention having doors 12 mounted on a surrounding frame 14. The doors 12 have glass panels 16, which allow a customer to see items (such as those shown as 18 in FIG. 2) displayed on shelves 20 mounted inside the display case 10. The doors 12 shown in FIG. 15 are smaller double doors. However, any other type of door may be used, such as the door 12 shown in FIG. 1.

Elongated fluorescent tubes 34 are mounted horizontally inside the display case 10 as shown in FIG. 16. The tubes 34 may be mounted at any desirable location inside the display case 10. Lenses 36 are mounted around the fluorescent tubes 34.

The lenses 36, used for the display cases of FIGS. 15, 16, 18, 20 through 22, 24 and 25, may be any of the lens embodiments shown in FIGS. 3, 8, 9, 11, 13 and 14. Also, as explained above, any other type of lens or reflector may be used for the display cases that directs light toward the shelves 20 and/or the interiors of the display cases, such as parabolic reflectors or other reflectors, positive or negative lenses, a lens with prismatic or Fresnel surfaces, grooves, or a diffraction grating, a meniscus lens, a sheet of optical material wrapped or fitted around a light source having prismatic or Fresnel surfaces, grooves, or a diffraction grating in the sheet, a holographic lens or a lens formed in a film through holographic techniques, or any other type of lens used to direct or distribute light inside a display case or more uniformly over the length of a shelf. In addition, the light beam directed or distributed from the lenses 36 do not have to be focused, substantially parallel beams like beam 38 shown in FIG. 5. As such, light beams 158 and 160 are shown in FIG. 16 as wavy lines.

Preferably, lens 36 with one light-directing body 40 is used at each of the top and the bottom of the display case 10, and a double lens 36 with two light-directing bodies 40 is mounted next to the middle shelf 20. However, any type of lens may be used, as explained above. Also, the lenses 36 may be mounted at other locations inside the display case 10, e.g., at the top of the case 10 above the top shelf 20, halfway between the front and back of the case.

As shown mounted in FIG. 16, the top lens 36 preferably directs light beams 158 toward items (not shown) located on the top shelf, illuminating these items more uniformly than they would be illuminated without the lens 36. The middle lens 36 with two light-directing bodies 40 preferably directs light beams 160 toward items (not shown) located on the middle and bottom shelves 20. The bottom lens 36 directs light beams 158 toward the interior of the display case 12, and would be used to light items located on a shelf (not shown) mounted near the bottom of the case 10.

Figure 17:
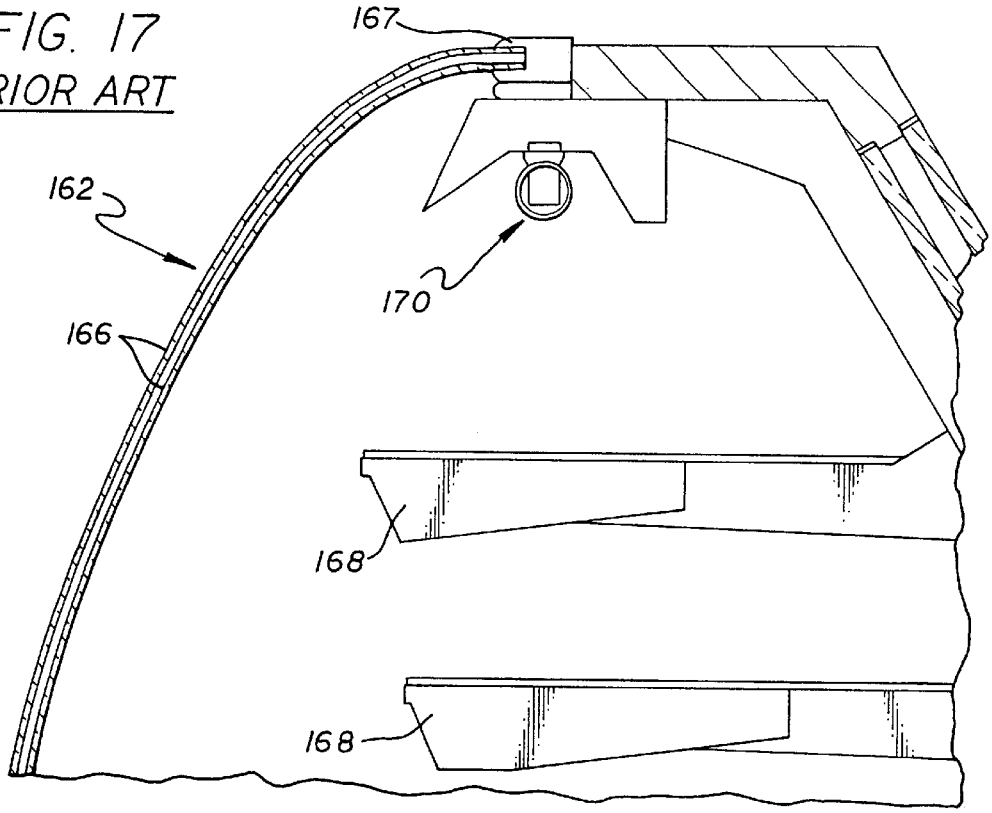
FIG. 17 PRIOR ART
FIG. 17 is a side elevational view in partial cross-section of a prior art deli-type display case having a horizontally-mounted light source.
Figure 19:
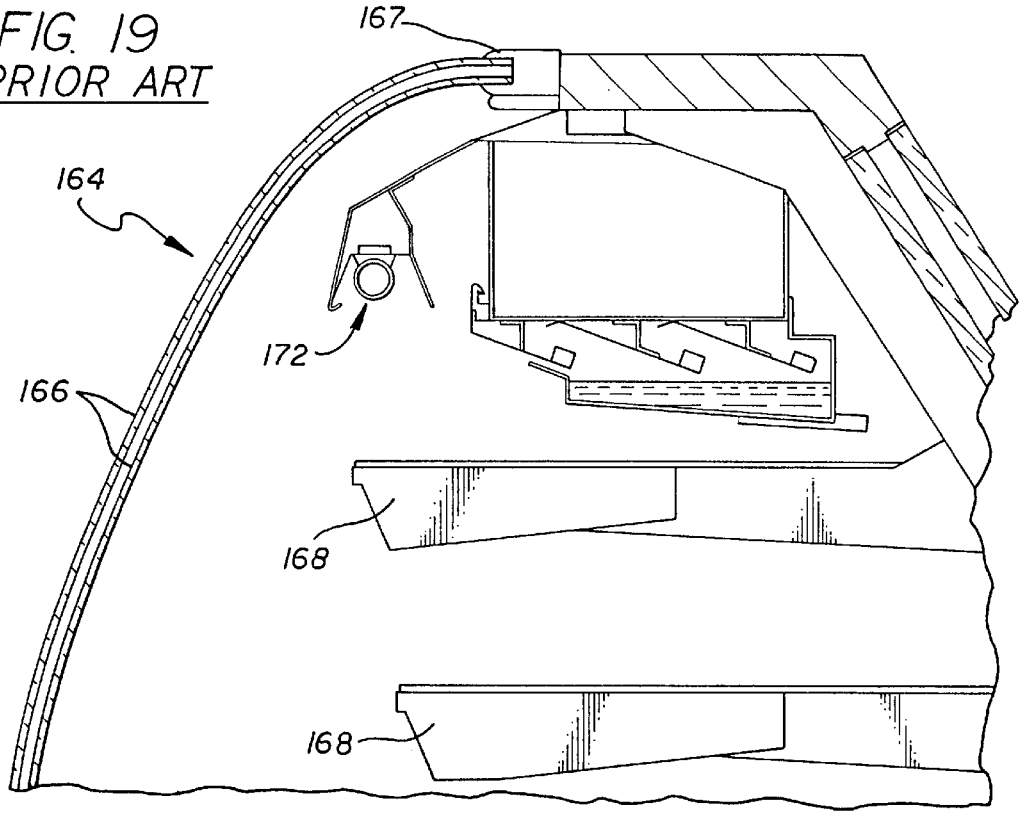
FIG. 19 PRIOR ART
FIG. 19 is a side elevational view in partial cross-section of another prior art deli-type display case having a horizontally-mounted light source.

FIGS. 17 and 19 show conventional deli-type display cases 162 and 164, having fixed front glass panels 166, mounted on a surrounding frame 167, which allow a customer to see items (not shown) located on shelves 168 mounted inside the cases which are accessed from behind the case. The deli-type cases 162 and 164 have light sources 170 and 172, respectively, mounted horizontally inside the case.

As explained above, light from the light sources 170 and 172 of the conventional cases follows the inverse-square law. Illuminance provided to items located on the shelves 168 inside the cases 162 and 164 will be inversely proportional to the respective squares of the distances between the items and the light sources 170 and 172. In other words, items located on the shelves 168 immediately below the light source 170 of FIG. 17 will be illuminated better than items located toward the front and the back of the shelves 168. Also, items located on the front of shelves 168 and immediately below the light source 172 of FIG. 19, will be illuminated better than items located toward the back of the shelves 168. This results in an uneven light distribution, with some items on the shelves 168 being illuminated better than other items on the shelves.

Figure 18:
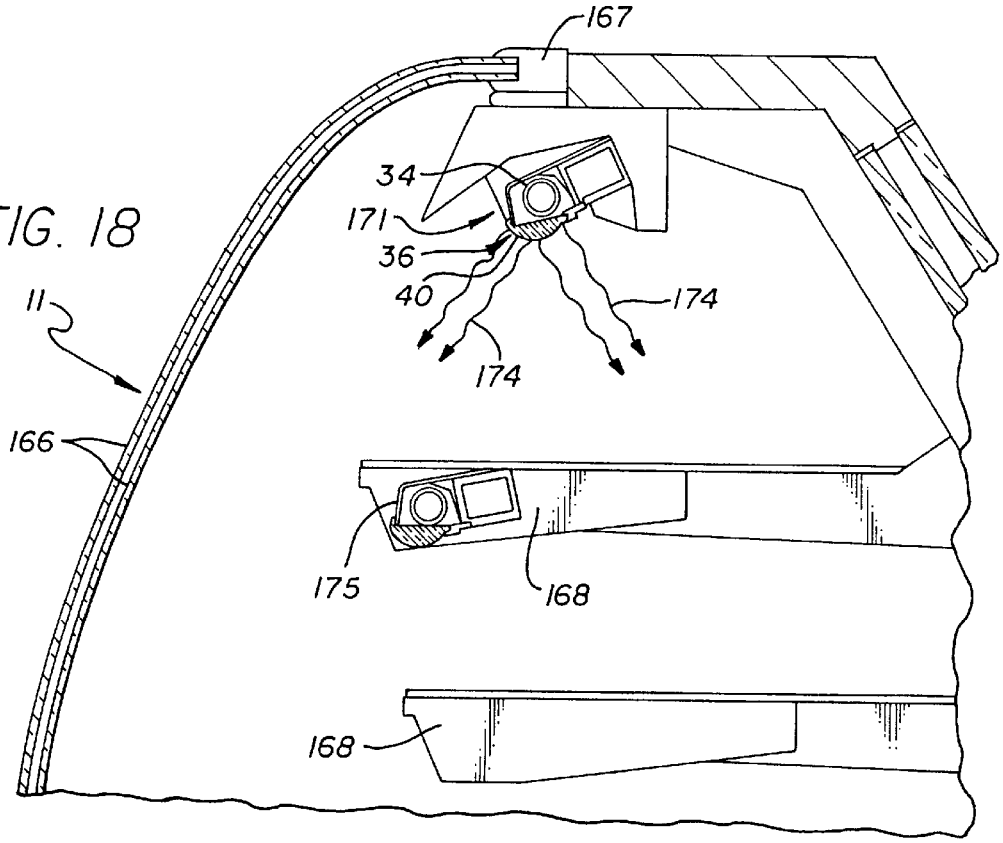
FIG. 18 is a side elevational view in partial cross-section of another embodiment of a display case with the present invention, which is a deli-type display case having a horizontally-mounted lens used to direct light toward shelves in the case.

The deli-type display case 11 of the present invention shown in FIG. 18 may take any number of configurations, such as a case with or without a door, with or without a viewing window and therefore open, and the light source may be placed in a number of locations including having multiple light sources, as desired. The display case 11 uses a horizontally-mounted light source 34 having preferably a single lens 36 which is positioned adjacent the light source 34 (e.g., a fluorescent tube) as shown in FIG. 18. The lens 36 has one or more light-directing bodies 40 which directs or distributes light beans 174 more uniformly over the length and depth of the shelves 168 than the light source 170 used for the conventional case 162. As a result, items located at the front and the back of the shelves 168 and below the lens 36 are sufficiently illuminated. This provides a considerable advantage over the conventional deli-type case of FIG. 17. The case may have additional light sources 34 (not shown) positioned either on the case or on additional shelves, such as on the bottom front of the top shelf 168. The structure of the lens, housing and their support structure is preferably substantially similar, if not the same as, the assembly shown in FIGS. 9 or 14. If necessary, the frame structure (89 and 131 in FIGS. 9 and 14, respectively) may be modified to accommodate the structure of the display case to which it is mounted.

Figure 20:
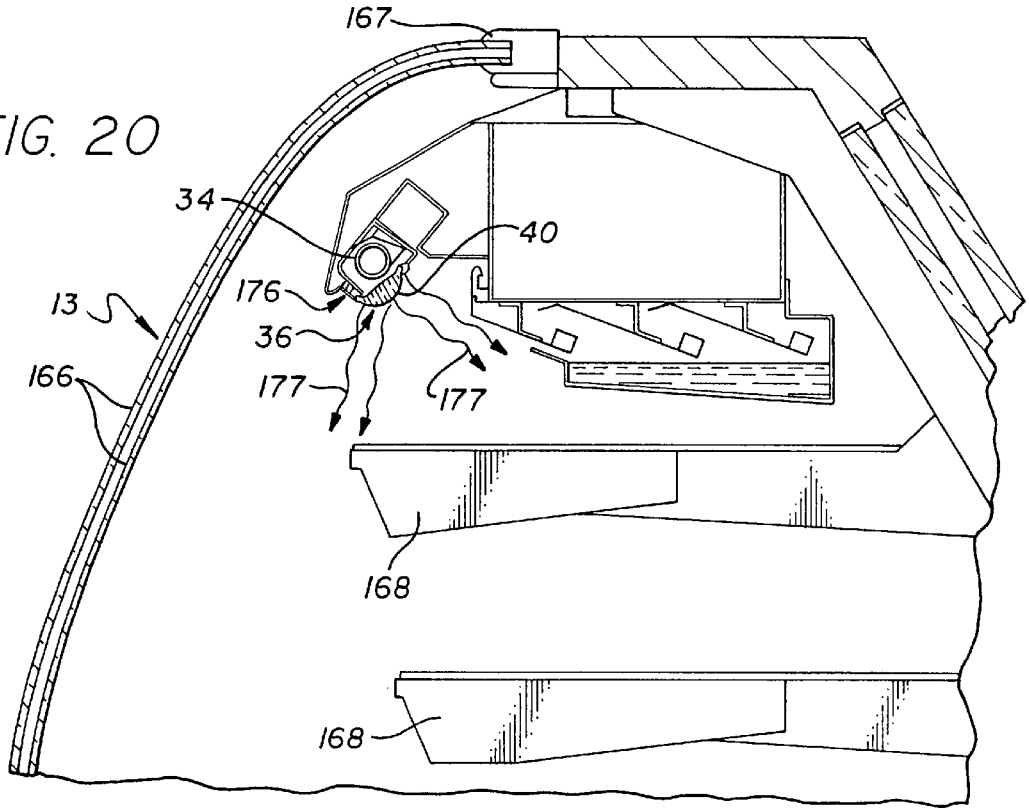
FIG. 20 is a side elevational view in partial cross-section of another embodiment of a display case with the present invention, which is a deli-type display case having a horizontally-mounted lens used to direct light toward shelves in the case.

The deli-type display case 13 of the present invention shown in FIG. 20 also provides advantages over the conventional deli-type display case of FIG. 19. The lens 36 used for case 13 preferably has one light-directing body 40, which distributes light beams 176 from horizontally mounted fluorescent tube 34, more uniformly over the length and depth of the shelves 168 than the light source 172 of the conventional case 164. As such, lens 36 lights or illuminates items located toward the back of the shelves 168 in addition to items located near the front of the shelves 168. The case 13 may configured with additional light sources as desired, as mentioned previously with respect to FIG. 18.

FIG. 25 shows another embodiment of the display case 10 of the present invention. The display case 10 is a salad bar-type display case 15 having a horizontally-mounted dual lens 36 with two light-directing bodies 40, which surrounds a horizontally-mounted light source 34 (e.g., a fluorescent tube). Raceways 178 may be located near the ends of the lens 36 in order to support the lens 36 and to provide sufficient space to locate the wiring and ballast used for the lens lighting system. The lens 36 is used to direct or distribute light more uniformly over the width of a table or support used for displaying food items 180 located below the lens 36. Glass panels 182 may be located above the food items 180. The panels 182 allow a customer to see the food items 180 displayed on the table.

Figure 21:
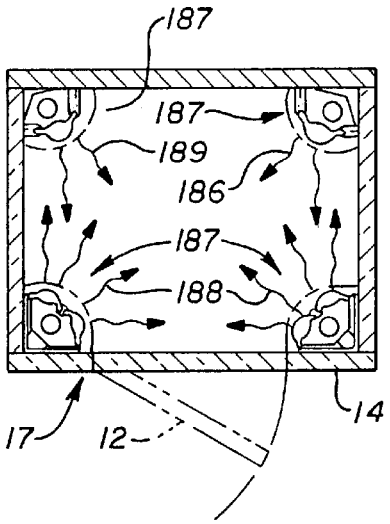
FIG. 21 is a perspective view of another embodiment of a display case made according to another aspect of the present invention having vertically-mounted light sources and lenses at the corners of the case, the display case being represented by broken lines.
Figure 22:
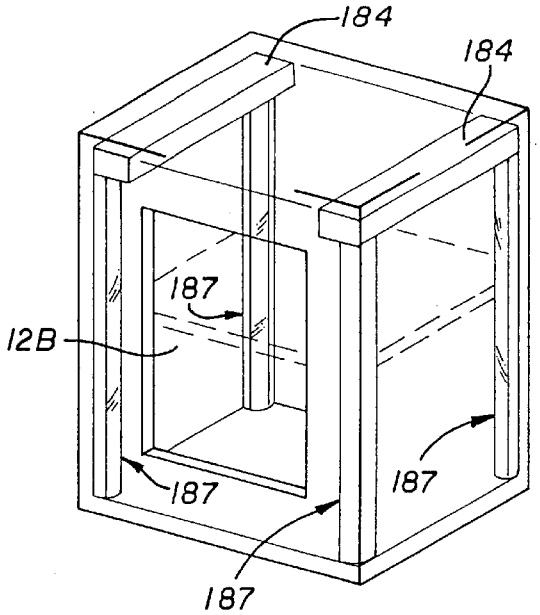
FIG. 22 is a transverse cross-sectional view of the display case of FIG. 21, showing how lenses with one light-directing portion and with two light-directing portions direct light toward the interior of the case.
Figure 24:
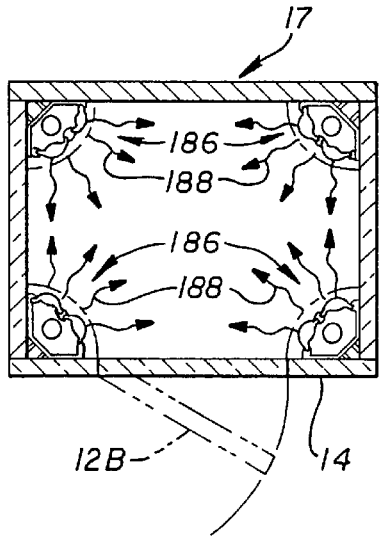
FIG. 24 is a transverse cross-sectional view of a display case similar to that of FIG. 21, showing how the lenses of FIG. 23 mounted at the corners of the case direct light toward the interior of the case.

FIGS. 21, 22 and 24 show another embodiment of the display case such as a portable or movable display case 17 having vertically-mounted lamps and their lenses 36 at the corners of the case 17. The display case 10 may be a stationary or movable display case, and may have any number of glass panels located on any side of the case for viewing items (not shown) located on shelves (not shown) mounted inside the case. If desired, the display case 17 may also be used without shelves, or may be used for displaying clothes or other items. Also, mannequins may be located inside the display case, and used to display clothes. The display case 17 may also have any number of doors, and may be used for any desirable purpose.

As shown in FIG. 21, raceways 184 may be mounted horizontally at the top of the display case 10 in order to provide sufficient space for wiring and ballast used for the lens lighting system. Alternatively, the lenses 36 may be mounted horizontally and the raceways 184 may be mounted vertically. In addition, the raceways 184 may be mounted horizontally at the bottom of the display case 17. Also, both horizontally- and vertically-mounted lenses 36 may be used inside the same display case 17. As explained above, any type lens or reflector may be used for the lens 36, which directs or distributes light beams toward the center of the display case.

FIG. 22 shows a display case 17 having a pair of lenses 36 with two light-directing bodies 40 mounted at the front corners of the case 17, and a pair of single lenses 36 with one light-directing body 40 mounted at the back or rear corners of the case 17. The front and rear lenses 36 direct light beams 188 and 186, respectively, toward the interior of the display case 17. Alternatively, FIG. 24 shows a display case 17 having four dual lenses 36 with two bodies 40 at four corners of the case 17, which direct light beams 188 toward the interior of the case 17. In a display case having an array of shelves with product, more light is preferably directed along the visible sides of the shelves. Any number or type of lenses 36 may be used at the corners, junctions or sides of the display case 17.

Figure 23:
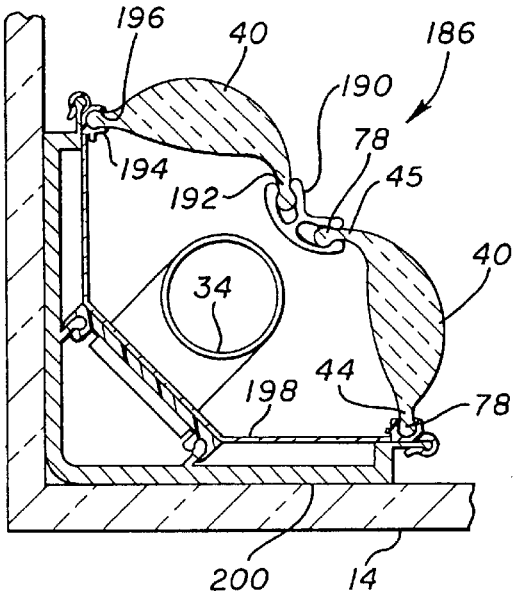
FIG. 23 is an enlarged cross-sectional view of another embodiment of one of the lenses of FIG. 22 having two light-directing portions.

Another embodiment of the lens 36 is shown in FIG. 23. This embodiment may be used in a corner of the display case 17 of FIG. 21 as explained above. The lens 36 has two light-directing bodies 40 releasably connected by elongated web member 190. A mullion cover 198 is used to mount the lens 36 to a mullion 200. Elongated cylindrical portions 78 of portions 40 releasably engage elongated apertures 196 in elongated extensions 194 of the mullion cover 198. Also, elongated cylindrical portions 78 of portions 40 engage elongated apertures 192 of web member 190. Reflectors (not shown) are preferably used with the lens 36 of FIG. 23.

An alternative embodiment of the lens and lamp assembly is shown in FIGS. 25 and 26, wherein a film lens in the form of a sheet of transmissive material 202 is shown mounted to the frame adjacent the lamp bulb 34. The sheet of material is preferably a flexible material easily manufactured and manipulated to the desired form to extend about a portion of the lamp so that light is directed to the desired areas in the display case. In the preferred embodiment, the light-directing portion of the lens is formed in the material by such means as a prismatic configuration or a diffraction grating 204 on the inside surface of the material formed according to conventional methods. The light directing portion is preferably formed on the inside surface to prevent damage or marring of the surface by impact or by contamination from external substances. The light directing portion is formed so as to have a circumferential distribution about the inside of the material which would produce the desired light distribution. The grating 204 shown in FIG. 28 is intended only to represent the grating or prismatic surface and not to represent the spacing or relative distribution of the respective lines. The distribution will depend on the desired light distribution.

It is important to note that any features of one of the embodiments of the lens 36 may be used with any other embodiment of the lens 36. Also, any features of any embodiment of the display case 10 may be used with any other embodiment of the display case 10.

Figure 29:
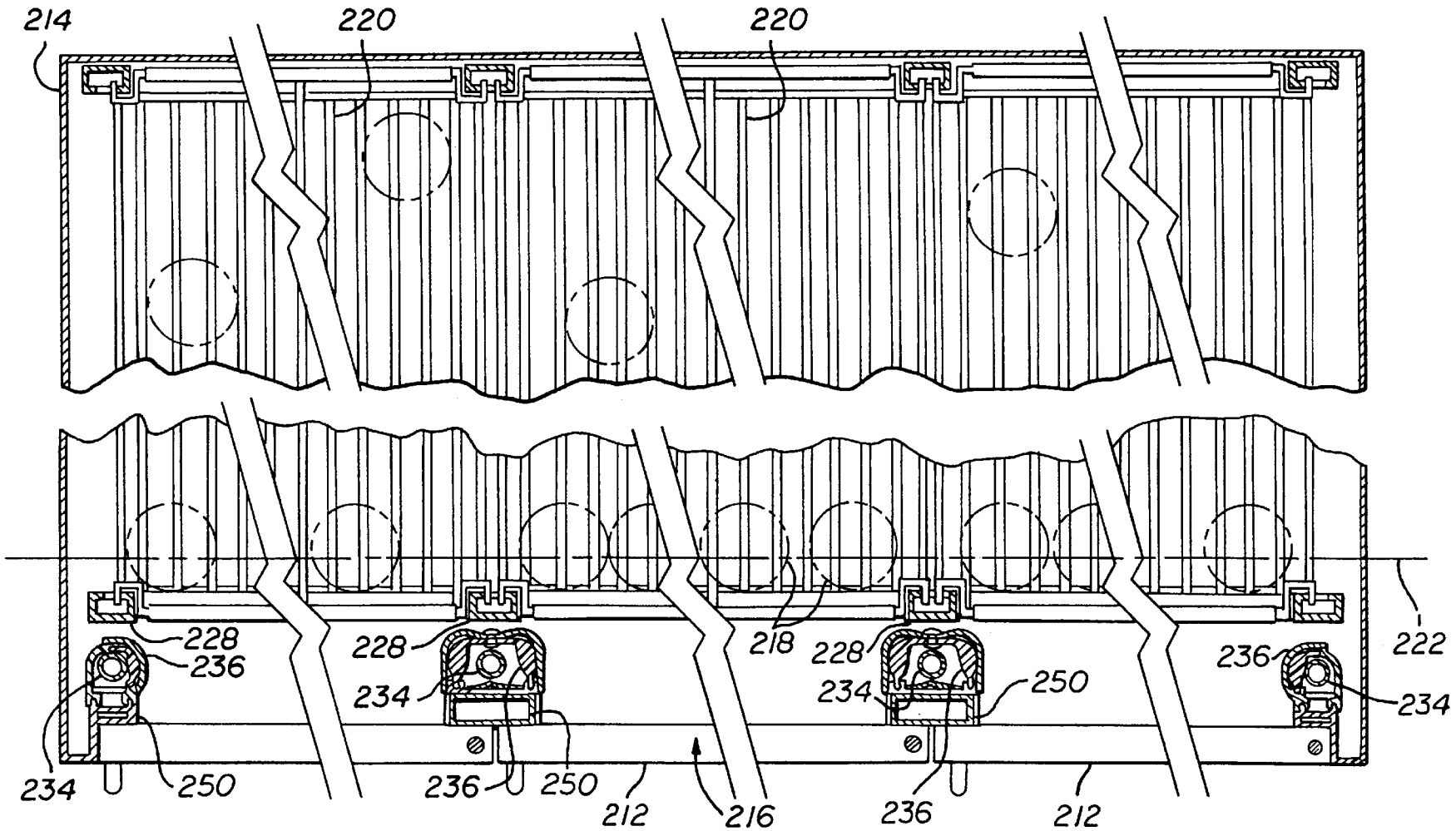
FIG. 29 is a partial cross-sectional and segmented view of a display case showing lenses for directing light wherein the lenses are mounted adjacent light sources within the display case.

Referring to FIG. 29, a display case 210 according to one aspect of the present invention is shown having doors 212 mounted on a surrounding frame 214 to close and seal an opening in the surrounding frame. FIG. 29 is a simplified schematic drawing to illustrate relative positioning of several components within a display case 210, and is not drawn to scale. Other detailed aspects of a typical display case such as rear access doors, wall construction and the like are not shown. Additionally, FIG. 29 does not illustrate the construction of the frames in which the doors 212 are placed, nor the proper spacing for the doors, for example, but provides a general plan view as to the relative positioning of several components found in a display case. However, it is intended that the case represent a standard case having typical shelf widths around 22 to 30 inches, a shelf depth of about 27 inches (about 34 inches from the frame flange of the surrounding frame) and other typical dimensions.

The doors 212 typically have transparent glass panels 216 which permit a customer to look through the panels at items or products 218 displayed on stem supports or shelves 220. The shelves 220 may be mounted adjacent to each other at the same height or level with respect to each other within the display case 210 and/or one above the other. Display items 218 which are placed near the front and middle portion of prior display shelves appear inadequately illuminated by mounted lighting tubes within the display case. Such light systems for display cases inherently produce undesirable contrasting illumination between displayed items 218 within the case 210. Display items 218 positioned near conventional light sources within the case appear excessively illuminated, while items located further away from the lighting appear insufficiently illuminated. In addition, intense localization of light from the lamps impairs the visibility of products 218 located on portions of the shelves near the lamps. Consumers may also find the intense light visible directly from the lamp distracting thereby diverting attention away from products stored within the display case. It is also found that light emitted from the bare lighting tubes shines into the display case away from the front viewing portion of the shelves where the light is not considered as important. Finally, even if lighting were increased to better illuminate the middle of shelves, the undesirable contrasting effect and appearance of non-uniformity would still be produced when looking at items stored across the case shelves. Increasing the lighting from the tubes would also increase the energy consumption for lighting the display case 210.

Contrasting illumination of display items between the end and the middle of the shelves 220 could be reduced by positioning the shelves further away from the lighting tubes 234. Because light intensity decreases relative to the inverse square of the distance, setting back the shelves 220 reduced contrasting illumination and any perceived glare at a given point on the shelf. However, when the fronts of the shelves are pushed further back into the display case 210, valuable storage space is lost in a highly visible front portion of case, near the doors and near the lamps. Display items 218 also appear more distant when placed on recessed shelves positioned further away from the viewing panels 216 in the doors 212, and affects the presentation of the displayed products 218 within the display case 210.

Figure 30:
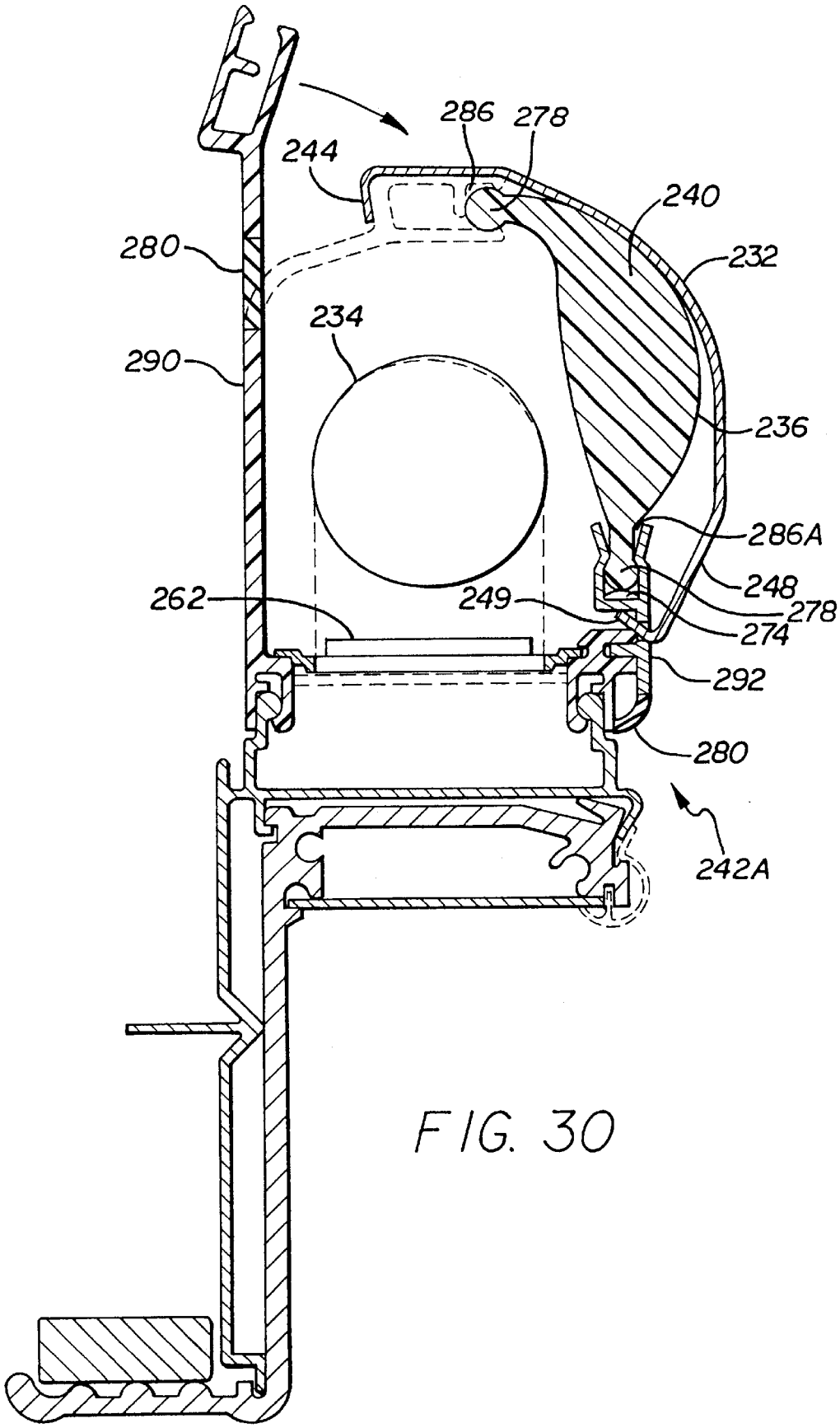
FIG. 30 is an enlarged cross-sectional view of an alternative embodiment of the lens positioned adjacent lighting at one end of the display case showing an alternative structure for mounting of the lens with the lens mounting groove in combination with a lens retaining element.

In the present invention, as shown in FIG. 29, display items 218 are often positioned at a viewing plane 222 which is defined to include the forwardmost portion of the product support portions of the shelves 220 for purposes of the present description. The viewing plane 222 across a shelf 220 permits the viewing of an entire line or row of product 218 displayed on and across the shelf or item support 220. The lenses 236, as shown in FIGS. 29 and 30, direct the light emitted from the light tubing or lamp 234 across the viewing plane 222 of the shelves 220. It has been found that even if the light-focusing portion 240 of the lenses 236 provide generally about the same amount of lighting to the front and middle portion of a shelf 220 as would be possible without the lenses 236, within the ranges perceptible to the human eye, the lenses still beneficially reduce the intensity of the light at the end portion of the shelf 220 near the lighting tubes 234. As a result, both the shelves 220 and display items 218 may be positioned closer to the light tubing 234, and in turn, closer to the glass panels 216, thereby increasing available shelf space and placing product closer to the consumer. Moreover, it is believed that the product can be positioned closer to the consumer without affecting the lighting of product at the front middle of the shelf relative to lighting without the lens. Therefore, the viewing plane 222 of items displayed on the front portion of the shelves 220 can be brought closer to a viewer. Since the amount of light reaching items 218 on the display shelf 220 near the lighting tubes 234 is reduced without significantly diminishing the amount of light illuminating the front middle portion of the shelf 220, the contrast or difference in illumination across the viewing plane 222 of the display shelves 220 is reduced by the light-focusing portion 240 of the lenses 236. In other words, the lenses 236 more evenly illuminate displayed items 218 located across the shelves 220 within the display case.

In the present invention, the lenses 236 also reduce glare, and direct the light from the light source tubes 234 across the viewing plane 222 or front portion of the shelves 220 rather than directly out to the customer. As shown in FIG. 29, the lighting tubes 234 are positioned adjacent the glass panels 216 of the doors 212. Bare lighting tubes 234 ordinarily produce undesirable glare to viewers looking into the display case 210 in the absence of the lenses 236 even when the customer is not trying to look directly at the light source. However, the lenses 236 in the present invention are placed immediately adjacent the lighting tubes 234 at opposite front ends of the shelves 220 to reduce the glare seen by a viewer outside the case resulting from the lighting tubes. The lenses 236 reduce the amount of light going directly from the lamp out of the case to the eye of a viewer while directing more light to product 218 within the viewing plane 222. As a result, visibility is improved and the distracting glare caused by a lighting tube 234 is reduced, which would otherwise divert the attention of a viewer away from items 218 stored in the display case 210.

The lenses 236 in the present invention reduce the intense illumination or the glare formed about display items 218 placed near the light tubing 234 thereby permitting the shelf 220 and product 218 to be placed closer to the light source. In effect, the lenses 236 increase the useable shelf space within the display case 210 since the shelves 220 may be positioned closer to the glass panels 216. The distance between the front end of the shelves 220 and the glass panels 216 may be approximately 5.437 inches to 6.187 inches and even as small as four inches in some situations. The distance between the front end of the shelves 220 and the lenses may be approximately 1.50 inches to 2.25 inches. The lenses 236 reduce the glare that would otherwise interfere with or detract from the viewing of items 218 placed near the light tubings 234. Since the lenses 236 permit the shelves 220 to be positioned close to the front viewing panels 216 of the display case 210, the shelf supports 228 may also be placed closer to the mullion 250 or front portion of the display case 210 and become more hidden from view.

Figure 33:
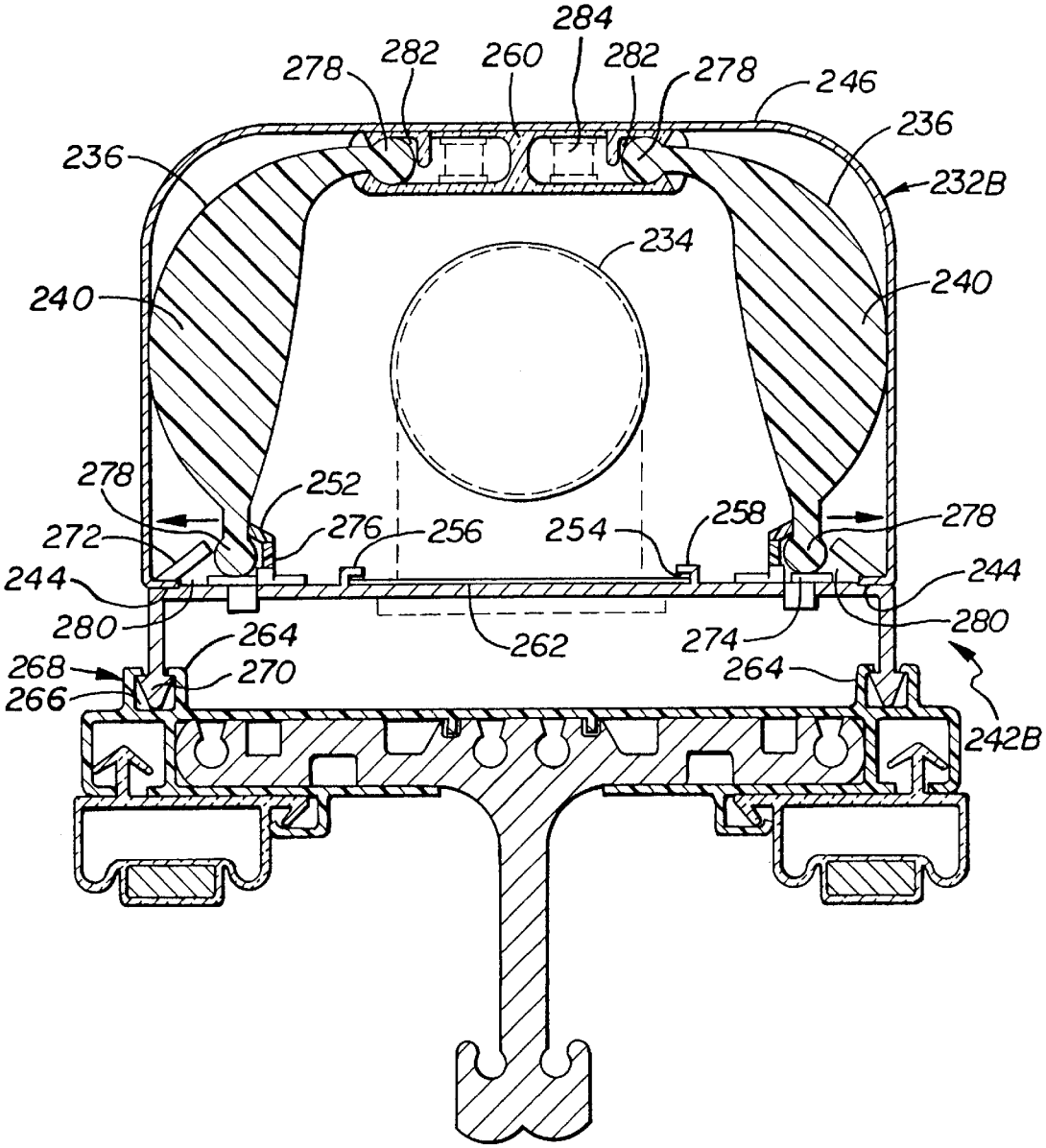
FIG. 33 is an enlarged schematic of a cross-sectional view of another embodiment of the lens and mounting arrangement with the lens mounted on a mullion through a more versatile mounting structure.

In the present invention, as shown in FIGS. 30, 32 & 33, the lenses 236 preferably have a larger outer dimension than the outer dimension of the light tubing 234 so as to prevent direct viewing of the light tubing 234 by a viewer. The distance between the inner surface of the lenses 236 and the light tubing 234 varies according to the specific configuration of the lenses which achieves reduced contrasting illumination across the viewing plane 222 of the display case 210. However, the distance between the outer surface of the light tubing 234 and the lens assembly may range from approximately 0.22 to 0.84 inches. It should be noted that the configuration of the present lenses 236 are not limited to any specific geometry. However, the lenses 236 are preferably formed to direct light to the viewing plane 222 of the display case shelf 220, and achieve reduction of glare in the case 210 without substantial reduction of illumination to the middle front portion of the shelf. Any suitable translucent materials, such as plastic, may also be used to form the lenses 236. The lenses 236 in the present invention preferably have a solid configuration as shown in FIGS. 30, 32 and 33. However, the lenses 236 may also be formed with less material using known techniques, while reducing both glare and contrasting illumination across the viewing plane 222 of the display came 210.

In FIGS. 30 and 33, alternative embodiments of the lens assembly mounting are shown. A housing portion 242A/B of the lens assembly secures the complete light and lens assembly in place to the mullion portion of a display case frame. More specifically, in FIG. 33, an arrow-shaped male member 270 of the housing 242B may be removably locked in place within a receiving box or open channel 268, both of which extend along the length of the housing, which is defined by extending walls 264 and 266. Walls 264 and 266 extend from a plastic cover over the mullion member.

FIG. 30 illustrates another embodiment of the lens assembly mounting also having removably connected housing and mullion cover portions. Thus, the entire light and lens assembly may be removed and replaced with other compatible lens assemblies as a result of the interchangeable and universal mounting elements formed in both the mullion and the housing portion of the lens assembly. The attachment or mounting mechanism of FIG. 33 is particularly beneficial because the raceway area, defined by the facing walls of the mullion cover and the housing and into which conductors for the lamps may be placed, may be varied and easily changed by mounting a new light and lens assembly.

The housing portion surface facing a lighting tube 234 may also include a reflector 262, as shown in FIGS. 30, 32 and 33. As shown in FIG. 33, a reflector 262 may be slidably mounted or retained within a channel or groove 254 defined by side extensions 256 and 258. Side extensions 256 and 258 are preferably formed as part of the lens housing 242, and may be further formed as an L-shaped portion that overlaps the outer edge of the reflector 262 so as to secure the reflector in position. Alternatively, as shown in FIG. 30, the reflector 262 (FIG. 30) may simply be fixed in place by appropriate means such as fasteners, holders or adhesives. In FIG. 32, an alternate embodiment of the reflector 262A is shown having a formed peak so as to reflect light toward the lenses 236, and generally away from the light tubing 234. The ends of the peaked reflector 262 may be held secured within a channel 254 similar to the lens assembly described in FIG. 33. The flat reflectors 262 are preferred, however, because it is believed that the peaked reflector increases light falling at the ends of the shelves, adjacent the light sources.

As shown in FIGS. 30, 32 and 33, the lenses 236 have a mounting portion 278 which engages a lens mounting groove 280. In FIG. 33, the lens mounting groove 280 is formed by a relatively rigid angled extension 272 of the housing 242, and another relatively rigid extension 276 of the housing. A relatively flexible portion 252 adjoined to or co-extruded with extension 276 helps to retain the elongated cylindrical mounting portion of the lens 278. Flexible portion 252 urges the lens mounting portion 278 against angled extension 272 so as to removably hold the lens 236 in place as indicated by the arrows. It should be noted that FIG. 33 is a conceptual illustration of an alternate lens lighting system and is not drawn to scale in its entirety.

In preferred embodiments of the present invention, FIGS. 30 and 32, the lens mounting groove 280 may be formed of deformable plastic or any other suitable material that permits the lens mounting portion 278 to be removably locked within the mounting groove. As shown in FIGS. 30, 32 and 33, the lens mounting groove 280 preferably has a strip or liner of non-slip material 274 in the groove so as to further retain the lenses 236 in place and prevent sliding of the elongated cylindrical portion of the lens 278 relative to the lens mounting groove 280. When multiple lenses 236 are utilized, as shown in FIGS. 32 and 33, the opposite lens mounting portions 278 may also engage a bridge mounting groove 282 formed within a connecting bridge member 260 for assisting in properly positioning the lenses.

A lens retaining element or clip 232 may be used also, or instead, to secure the lenses 236 in place within the lens mounting groove 280. One form of the lens retaining element 232A is preferrably held in place as shown in FIG. 32 with a fastener 238, such as a screw or rivet through a hole 239, for maintaining the lens 236 and lens retaining element in a relatively fixed position. The lens retaining element or clip 232 is preferably formed from a resilient metal band with a centered hole to receive the lens retaining element fastener 238. The clips 232 also have elongated flanges 244 for engagement with the housing 242 so as to retain the lens 236 and lens retaining elements 232 fixed relative to the display case frame 214. As shown in FIG. 33, the lens retaining element 232B may fix multiple lenses 236 in place and form a relatively straight-lined border 246 surrounding the lenses. Depending on the relative sizes and geometry of the lens and lens retaining element 232, a portion of the retaining element may protrude away from the lens as shown in FIGS. 30 and 32. When the lens retaining element 232 is fixed in place with a fastener 238, the retaining element may slightly deform and form a bowed portion 248 (FIG. 32) away from the lenses.

When multiple lenses 236 are mounted adjacent a light source 234, as mentioned above, and shown in FIGS. 32 and 33, a connecting bridge member 260 may be used to connect the lenses. The bridge member 260 preferrably has substantially the same length as the lenses 236, and is formed with a mounting groove 282 to receive the cylindrical mounting portion 278 of the lenses. In addition, an end cap may be fitted at either longitudinal end of the bridge 260 so as to minimize sliding of the lens 236 relative to the bridge member As shown in FIG. 33, the end cap may be formed with fingered projections 284 extending into open spaces within the bridge in order to provide a more secure fit between the end cap and the bridge member, and the retained lens mounting portion 278.

As shown in FIG. 30, the lens mounting portions 278 of a lens 236 may be fixed in position by an elongated member 290 and a removably locking elongated ember 292. Both elongated members 290 and 292 are formed with relatively flexible portions 280 and mounting grooves 286 and 286A for receiving the lens mounting portions 278. Elongated member 290 may be flexed toward the light tube 234 so as to also engage the lens clip or lens retaining element 232. The flange 244 of the clip retains the elongated member in place, and in flexed position, so as to also hold the clip itself in position. At the same time, the removably locking elongated member 292 is secured in place by the clip 232, and vice-versa. The flexible portion 280 of the removably locking elongated member 292 permits the member to flex into position so as to combine with the lens clip 232 and the mounting portion 278 of the lens. In addition, member 292 may be formed with an extension along the length of the member that removably locks into, or is received by, an aperture formed in the lens assembly. Portions 280 may be formed of a flexible material, such as flexible PVC, GEON 83718, or any other suitable material. The relatively rigid portions of elongated members 290 and 292 may be formed of more rigid material such as rigid PVC, GEON 87256, HUGHES H600, or any other suitable material. It should be noted that the lens receiving portions of the previously described embodiments, which also have partially rigid and flexible regions, may be constructed from similar materials.

As mentioned above, the lenses 236 in the present invention direct light into the viewing plane 222 of display case shelves 220. However, a lens 236 is one example of an optical element or component capable of directing light within a display case such as a refrigerated display case commonly found in supermarkets and which reduces glare as seen by the customer. Other optical components that may direct light and reduce glare to the viewing plane 222 of a display shelf 220 further include reflectors, and louvered apertures. However, other optical elements besides lenses may produce a more contrasting effect and illumination between the items within the viewing plane of a shelf, and other non-viewing portions of the display case, which may be undesirable.

In one embodiment of the present invention, as shown in FIG. 29, contoured lenses 236 may be positioned at opposite ends of the viewing plane in a display case shelf 220. The lenses 236 direct light emitted from the light source tubing 234 into the viewing plane 222 for items 218 on the display shelves 220. In addition, display items 218 located within the viewing plane 222 on the display shelf 220 are illuminated in contrast to other non-viewing portions within the display case 210 such as the rear portion of the display case and shelving posts 228 or hardware. Since light from light tubing 234 is being directed toward the viewing plans 222 of the display shelf 220, and away from other non-viewing regions within the display case 210, more attention may be directed to the display items 218 on the shelves 220 within the viewing plane. Thus, the lenses 236 in the present invention decrease the contrasting illumination of items 218 within the viewing plane of a display case, and simultaneously increases the contrasting illumination between products 218 within the viewing plane and other non-viewing portions of the display case 210.

Figure 30A:
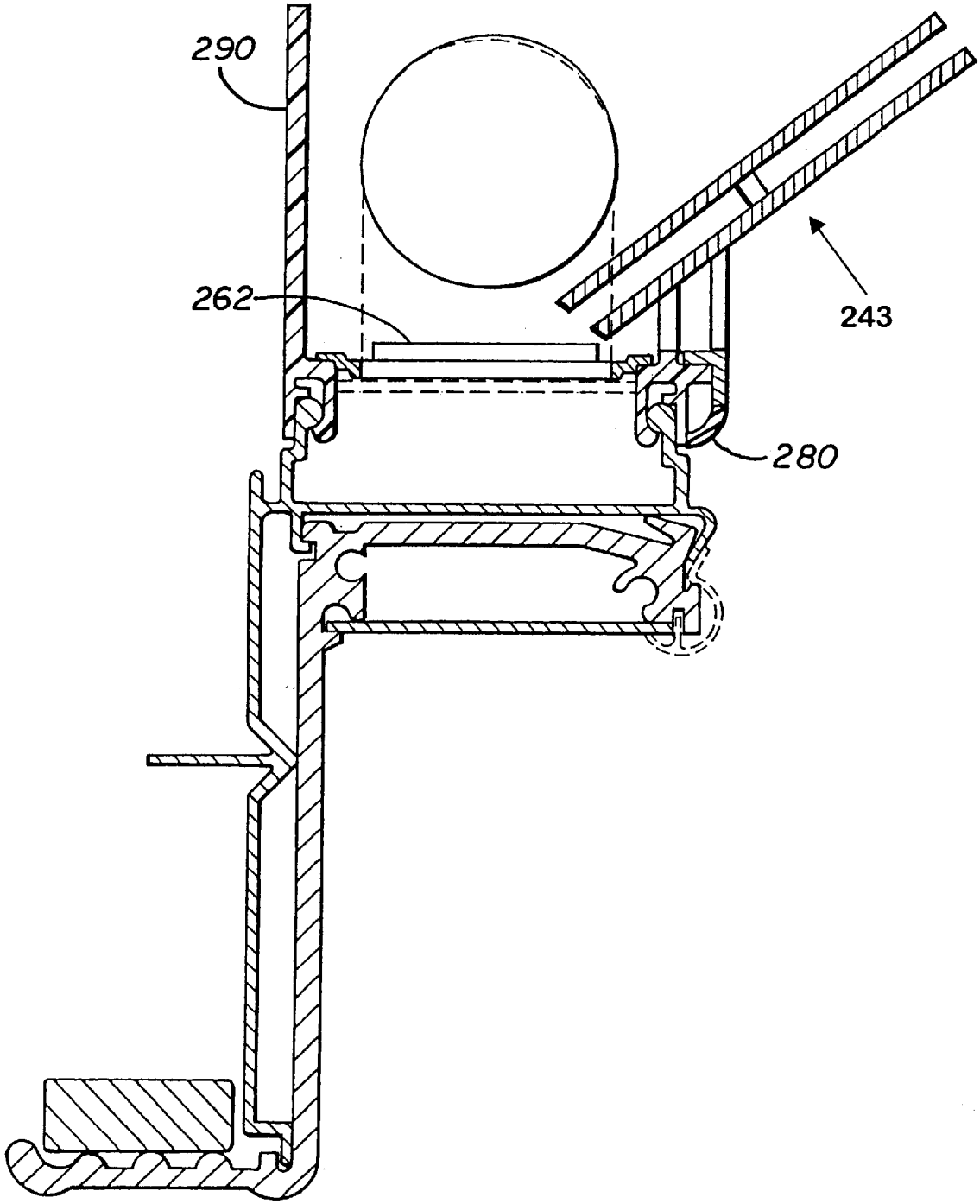
FIG. 30A is an enlarged cross-sectional view of an alternative embodiment of an optical element positioned adjacent a light source in a display case.

FIG. 30A shows a lighting system using a louvered optical element 243 for reducing the amount of light shining directly from the light source to a customer outside the case. The louvered optical element may be formed from an opaque or reflective material for reducing the amount of light from the light source which shines directly outside the case. The louvered optical element may also include an opaque panel or other structure between the light source and the end of the shelf to reduce any excessive glare occurring at the end of the shelf. In the preferred embodiment, each panel of the louvered optical element is supported at the top and bottom by a suitable support structure. Spacers may be included at appropriate locations along the panels to maintain the panels spaced apart. Any number of panels can be used to achieve the desired result. For example, panels can be positioned about a portion of the circumference of the lamp, with any desired spacing to achieve the desired reduction of glare seen by the customer.

The above description discloses the preferred embodiments of the present invention. However, persons of ordinary skill in the art are capable of numerous modifications once taught these principles. Accordingly, it will be understood by those skilled in the art that changes in form and details may be made to the above-described embodiments without departing from the spirit and scope of the invention.

What is claimed is:

1. A refrigerated display case used for displaying items, the refrigerated display case comprising:

an insulated surrounding frame;

at least one shelf positioned inside the display case for supporting an item in the display case;

a viewing plane defined by a forwardmost position available to an item for display on the at least one shelf;

at least one light source inside the display case for providing light to illuminate an interior portion of the refrigerated display case; and a louvered optical element positioned inside the refrigerated display case and substantially adjacent the at least one light source for reducing light emitted directly out of the case wherein the louvered optical element includes at least one substantially opaque panel for allowing light to pass from the light source to the shelf but reducing the light passing from the light source directly to the outside of the case.

2. The refrigerated display case of claim 1 further including first and second light sources, and wherein the shelf has a front and first and second ends, and wherein light sources are located substantially adjacent the first and second ends respectively.

3. The refrigerated display case of claim 1 wherein the refrigerated display case is used for displaying food items.

4. The refrigerated display case of claim 1 wherein the viewing plane includes the front of the at least one shelf, and wherein the optical element reduces the contrasting illumination across the front of the at least one shelf.

* * * * *